US007551053B2

(12) United States Patent
Yamashita et al.

(10) Patent No.: US 7,551,053 B2
(45) Date of Patent: Jun. 23, 2009

(54) COIL DEVICE

(75) Inventors: Mitsuhiro Yamashita, Tokyo (JP); Takashi Nagasaka, Tokyo (JP); Hideki Miura, Tokyo (JP); Yasuhiro Matsukawa, Tokyo (JP); Kazuo Sato, Tokyo (JP); Akira Sato, Tokyo (JP); Hironori Sato, Tokyo (JP); Takayuki Ito, Tokyo (JP); Yasuhiko Kitajima, Tokyo (JP)

(73) Assignee: TDK Corporation, Tokyo (JP)

( * ) Notice: Subject to any disclaimer, the term of this patent is extended or adjusted under 35 U.S.C. 154(b) by 439 days.

(21) Appl. No.: 10/575,470

(22) PCT Filed: Nov. 5, 2004

(86) PCT No.: PCT/JP2004/016426

§ 371 (c)(1),
(2), (4) Date: Apr. 12, 2006

(87) PCT Pub. No.: WO2005/045859

PCT Pub. Date: May 19, 2005

(65) Prior Publication Data

US 2007/0063803 A1 Mar. 22, 2007

(30) Foreign Application Priority Data

| | | |
|---|---|---|
| Nov. 5, 2003 | (JP) | 2003-375434 |
| Aug. 24, 2004 | (JP) | 2004-244278 |
| Aug. 24, 2004 | (JP) | 2004-244279 |
| Aug. 24, 2004 | (JP) | 2004-244280 |
| Aug. 25, 2004 | (JP) | 2004-245723 |

(51) Int. Cl.
*H01F 27/29* (2006.01)

(52) U.S. Cl. ..... 336/192; 343/870

(58) Field of Classification Search ..... 336/65, 336/83, 192, 200, 220–223; 343/745, 787, 343/850, 870
See application file for complete search history.

(56) References Cited

U.S. PATENT DOCUMENTS

| | | | | |
|---|---|---|---|---|
| 5,896,077 | A * | 4/1999 | Cadwallader | 336/192 |
| 7,034,756 | B2 * | 4/2006 | Fujii et al. | 343/713 |
| 7,042,324 | B2 * | 5/2006 | Watanabe | 336/192 |
| 2007/0046413 | A1 * | 3/2007 | Yamashita et al. | 336/96 |

FOREIGN PATENT DOCUMENTS

JP 45-33405 12/1970

(Continued)

OTHER PUBLICATIONS

U.S. Appl. No. 10/571,771, filed Mar. 14, 2006, Yamashita et al.
U.S. Appl. No. 10/575,470, filed Apr. 12, 2006, Yamashita et al.

*Primary Examiner*—Tuyen T. Nguyen
(74) *Attorney, Agent, or Firm*—Oblon, Spivak, McClelland, Maier & Neustadt, P.C.

(57) ABSTRACT

A coil apparatus that can increase mechanical strength of terminal portions and assure sufficient impact resistant properties and vibration resistant properties even in an application in a severe use environment such as an in-vehicle coil apparatus. Terminals are formed of one metal sheet, and include an attachment portion, an intermediate portion, and a bottom portion. One end of the attachment portion is fixed at each terminal attachment portion of a core. One end of the intermediate portion is continuous with the other end of the attachment portion at a first bent portion. The bottom portion has a first end continuous with the other end of the intermediate portion at a second bent portion, facing the attachment portion, and a second free end. The intermediate portion has a hole in a plane thereof. In each hole, both inner edges that are opposed to each other in at least one direction have an arc shape.

23 Claims, 27 Drawing Sheets

FOREIGN PATENT DOCUMENTS

| | | |
|---|---|---|
| JP | 58-124213 | 7/1983 |
| JP | 59-166415 | 11/1984 |
| JP | 73229/1985 | 5/1985 |
| JP | 01-58907 | 4/1989 |
| JP | 01-206610 | 8/1989 |
| JP | 2-156513 | 6/1990 |
| JP | 02-224307 | 9/1990 |
| JP | 03-023604 | 1/1991 |
| JP | 44109/1992 | 4/1992 |
| JP | 5-21230 | 1/1993 |
| JP | 6-334091 | 12/1994 |
| JP | 7-130556 | 5/1995 |
| JP | 07-254515 | 10/1995 |
| JP | 09-0007852 | 1/1997 |
| JP | 09-306773 | 11/1997 |
| JP | 09-330826 | 12/1997 |
| JP | 272461 | 12/1997 |
| JP | 272642 | 12/1997 |
| JP | 10-092625 | 4/1998 |
| JP | 10-116719 | 5/1998 |
| JP | 10-172853 | 6/1998 |
| JP | 10-284325 | 10/1998 |
| JP | 10-294223 | 11/1998 |
| JP | 2001-155950 | 6/2001 |
| JP | 2001-267146 | 9/2001 |
| JP | 2001-313224 | 11/2001 |
| JP | 2001-339224 | 12/2001 |
| JP | 2002-93629 | 3/2002 |
| JP | 2002-329618 | 11/2002 |
| JP | 2003-318030 | 11/2003 |
| JP | 2003-332142 | 11/2003 |
| JP | 2004-48136 | 2/2004 |

* cited by examiner

COIL DEVICE

TECHNICAL FIELD

The present invention relates to a ferrite core and a coil apparatus using this ferrite core.

A coil apparatus according to the present invention includes an antenna which is applicable to an in-vehicle transponder, or a communication device inductor, a choke coil and others.

BACKGROUND ART

Various types of coil apparatuses have been conventionally proposed and come into practical use. As one of such apparatuses, a coil apparatus which can be applied as an in-vehicle antenna or a transponder has been recently proposed. In the coil apparatus which is applied to such an intended purpose, a ferrite core having excellent high-frequency characteristics is generally used. Further, a coil is wound around this ferrite core for the necessary number of times, and a coil end is connected with metal terminals provided at both ends of the ferrite core in a longitudinal direction so that an entire structure is covered with a thermosetting resin such as an epoxy resin.

As the ferrite core, it is general to use an elongated one having a large length seen from a direction of a winding axis of the coil so that an inductance value, a Q value and self-resonant frequency characteristics and others required in this type of coil apparatus satisfy requested values.

However, the ferrite core is a brittle sintered body, and essentially weak against impact shocks or vibrations. Moreover, the ferrite core must be formed into an elongated shape which is weak against impact shocks and vibrations for the above-described reason. Therefore, in case of an in-vehicle coil apparatus which is constantly exposed to impact shocks and vibrations, how a structure having excellent impact resistant properties and vibration resistant properties is realized is important.

Additionally, in not only the in-vehicle coil apparatus but also a coil apparatus which is used as a communication device inductor or a choke coil, a reduction in size, simplification of structure, a decrease in cost and others are always demanded, and hence how these demands are met is also an important problem.

In this point of view, considering a known technique, for example, Patent Reference 1 discloses a structure in which a synthetic resin base obtained by injection molding is attached at terminal attachment portions provided at both end portions of a ferrite core in a longitudinal direction and a metal electrode terminal is attached at an outer periphery of the synthetic resin base by its own spring action. In this prior art, however, it is difficult to meet demands such as a reduction in size, a simplification of structure, a decrease in cost and others.

As means for solving the above-described problem, Patent Reference 2 discloses a coil apparatus in which ingenuity is exercised with respect to a shape of a ferrite core, a terminal structure or the like to improve frequency characteristics, impact resistant properties and vibration resistant properties.

According to this prior art, a very satisfactory result can be expected in an application in a severe use environment such as an in-vehicle coil apparatus.

Further, as a coil apparatus which is applied to an intended purpose such as an in-vehicle antenna or a transponder, a surface mount type coil apparatus is used, and a reduction in size/thickness, impact resistant properties, vibration resistant properties, heat resistant properties and others are demanded, but an insulating sheath body which covers a core and a coil currently has a cross-sectional shape which is orthogonal to a coil winding direction being formed into a square shape in the surface mount type coil apparatus. Furthermore, in regard to a core accommodated inside, it is often the case that its cross-sectional shape is formed into a square shape in accordance with the insulating sheath body in view of characteristics as a coil.

However, in a coil apparatus in which a core has a square cross-sectional shape, cracks are found in an insulating sheath body in an inspection process in some cases. It can be considered that a coil winding is expanded due to heat when molding the insulating sheath body, a stress is concentrated by expansion at the part of the insulating sheath body which covers square angular portions of the core in particular, and cracks are thereby generated on an outer peripheral surface of the insulating sheath body.

On the other hand, forming the cross-sectional shape of the core into a circular shape with which a stress is hardly concentrated can be considered. However, when a circular cross section which internally touches the original square cross-sectional shape is accepted, a large cross-sectional area of the core cannot be assured, which is not preferable for characteristics. On the other hand, when the cross-sectional shape of the core is selected to be larger than the inscribing circular shape, a preferable wall thickness of the insulating sheath body cannot be assured or the entire coil apparatus is increased in size as a result of putting high priority to assuring a wall thickness because the insulating sheath body has the square cross-sectional shape.

Moreover, in not only the in-vehicle coil apparatus but also a coil apparatus used as a communication device inductor or a choke coil, electrical characteristics are greatly dependent on a core size. In general, better electrical characteristics can be obtained as the core size is increased.

However, since an outside dimension of the coil apparatus is restricted in accordance with its application, when the core size is increased in the restricted outside dimension, a thickness of the insulating covering body formed of a thermosetting resin such as an epoxy resin is relatively reduced, and all or a part of the core or the coil is exposed to the outside, so that impact resistant properties, vibration resistant properties, durability and others as a purpose of insulative covering are thereby hardly guaranteed. On the contrary, when the thickness of the insulating covering body is increased to assure impact resistant properties, vibration resistant properties, durability and others, the core size is reduced this time, thus sacrificing electrical characteristics. That is, in this type of coil apparatus, an important problem is how the core size is increased to assure high electrical characteristics without deteriorating impact resistant properties, vibration resistant properties and durability by insulative covering.

Additionally, considering an influence of the insulating covering body on the core, a structure which does not deteriorate characteristics of the core must be accepted.

In such a point of view, examining a known technique, Patent reference 1 mentioned above discloses a structure in which a synthetic resin base obtained by injection molding is attached at flange portions provided at both end portions of a core in a longitudinal direction and a metal electrode terminal is attached at an outer periphery of the synthetic resin base by its own spring action. However, this prior art does not disclose means for solving the above-described problem.

Although Patent Reference 3 discloses a structure in which an entire structure is covered with a sheath material such as a resin, it does not describe about a resin material constituting the sheath material, and likewise does not disclose means for solving the above-described problem.

Further, examining a known technique, for example, Patent Reference 3 mentioned above discloses a coil apparatus in which an entire structure is covered with a resin mold.

Furthermore, Patent Reference 2 mentioned above discloses a coil apparatus in which an entire structure is covered with an insulating resin and ingenuity is exercised with respect to a shape of a ferrite core, a terminal structure and others to improve impact resistant properties and vibration resistant properties.

Of these prior arts, according to Patent Reference 2 in particular, a very satisfactory result can be expected even in an application in a severe use environment such as an in-vehicle coil apparatus.

In the coil apparatus which is applied to an in-vehicle antenna or a transponder, a reduction in size is demanded, and a stable inductance in a working frequency range desired by a customer is also demanded. Therefore, there has been also devised a divided winding conformation in which a coil portion obtained by forming layers of a winding in a radial direction is divided in a direction of an axial center of a core so that divided coil portions are formed.

That is, in the divided winding conformation described in Patent Reference 2 mentioned above, although a flange integrally formed with the core is provided between adjacent coil portions, a further reduction in size and a decrease in core manufacturing cost can be achieved if such a flange can be eliminated, which will be more preferable.

However, when the divided winding conformation is accepted without providing the flange and a plurality of coil portions are sequentially formed, a winding of a precedently formed coil portion may possibly collapse during formation of a next coil portion.

Patent Reference 1: Japanese Patent Application Laid-open No. 2001-339224

Patent Reference 2: Japanese Patent Application Laid-open No. 2003-318030

Patent Reference 3: Japanese Patent Application Laid-open No. 130556-1995

DISCLOSURE OF THE INVENTION

Problem to be Solved by the Invention

The present invention provides a coil apparatus which is obtained by further improving the above-described prior arts, in which mechanical strength of a terminal portion is increased in particular, and which can assure sufficient impact resistant properties and vibration resistant properties even in an application in a severe use environment such as an in-vehicle coil apparatus.

In view of the above-described conventional problems, the present invention provides a coil apparatus which can prevent cracks from being generated in an insulating sheath body while satisfying demands of a reduction in size and a decrease in thickness.

Furthermore, the present invention provides a coil apparatus in which a core size is increased to improve electrical characteristics without deteriorating impact resistant properties, vibration resistant properties and durability by insulative covering.

Moreover, the present invention provides a coil apparatus in which a variation in an inductance value due to a fluctuation in a temperature is reduced.

Additionally, the present invention provides a coil apparatus which is obtained by further improving the above-described prior arts, in which heat radiation properties are increased in particular to improve thermal stability of characteristics, and which can assure sufficient thermal stability, impact resistant properties and vibration resistant properties even in an application such as an in-vehicle coil apparatus in a severe use environment.

In addition, the present invention provides a coil apparatus accepting a divided winding conformation and a manufacturing method of the coil apparatus which can prevent a winding from collapsing even though a reduction in size of a core and simplification of a structure are achieved.

MEANS FOR SOLVING PROBLEM

First Embodiment of the Invention

A coil apparatus according to the present invention comprises: a core; a winding; and a terminal. The core has terminal attachment portions at opposed both ends thereof, and has a winding portion in an intermediate portion thereof. The winding is wound around the winding portion. The terminal is a part to which an end of the winding is connected, formed of one bent metal sheet, and includes an attachment portion, an intermediate portion and a bottom portion.

One end of the attachment portion is fixed at the terminal attachment portion of the core. One end of the intermediate portion is continuous with the other end of the attachment portion at a bent portion. The bottom portion has one end which is continuous with the other end of the intermediate portion at a bent portion, faces the attachment portion, and has the other end as a free end.

Furthermore, the intermediate portion has a hole in a plane thereof, and both inner edges of the hole which are arranged to each other in at least one direction have an arc shape.

As described above, the terminal to which an end of the winding is connected is formed of one metal sheet, and includes the attachment portion, the intermediate portion and the bottom portion. One end of the attachment portion is fixed at the terminal attachment portion of the core. One end of the intermediate portion is continuous with the other end of the attachment portion at the bent portion. The bottom portion has one end which is continuous with the other end of the intermediate portion at the bent portion, and faces the attachment portion.

According to this configuration, spring properties provided by the two bent portions can be assured to absorb impact shocks and vibrations, thereby realizing the coil apparatus having excellent impact resistant properties and vibration resistant properties.

The intermediate portion is a part which faces an end surface of the core, and has a relationship in which its board surface is orthogonal to or crosses a magnetic flux caused by a current flowing through the coil. Therefore, the intermediate portion is an obstacle part which obstructs a smooth flow of the magnetic flux, and deteriorates frequency-inductance characteristics and frequency-Q characteristics. Thus, in the present invention, a hole is provided in a plane of the intermediate portion.

Since existence of the above-described hole realizes a structure in which a cross-sectional area of the intermediate portion is smaller than a cross-sectional area of each of the attachment portion and the bottom portion, an obstacle to the smooth flow of the magnetic flux is reduced, thereby suppressing deterioration in frequency-inductance characteristics and frequency-Q characteristics.

As described above, since provision of the hole in the intermediate portion reduces mechanical strength of the intermediate portion, a degree of this reduction must be suppressed. Or else, it is hard to assure impact resistant properties and vibration resistant properties demanded in an application in a severe use environment such as an in-vehicle coil apparatus.

As a countermeasure, in the present invention, both inner edges of the hole which face each other in at least one direction have an arc shape. According to the above-described hole shape, as different from a square hole having acute inner angles, it is possible to assure sufficient mechanical strength and satisfactorily meet impact resistant properties and vibration resistant properties which are demanded in an application in a severe use environment such as an in-vehicle coil apparatus.

The hole provided in the intermediate portion can take various conformations as long as the above-described requirements are satisfied. The following shows examples of such conformations.

(a) The hole is arranged to be biased in a direction of the attachment portion. According to this arrangement configuration, a solder fillet formation space can be increased below and beside the hole.

(b) Although a typical shape of the hole is a circular shape, it may be a non-circular shape.

(c) As an example of the non-circular hole, there is an example which has a short diameter and a long diameter, a direction of the short diameter matching with a direction from the attachment portion to the bottom portion.

(d) As another example of the non-circular hole, there can be a type which has a short diameter and a long diameter, a direction of the long diameter matching with a direction from the attachment portion to the bottom portion.

(e) As still another example of the non-circular hole, there may be a shape in which arc-like portions at both ends are continuous with each other through linear portions, which is a so-called track shape.

(f) As yet another example of the non-circular hole, there may be an elliptic shape.

Moreover, it is preferable for the terminal to have an extended width portion in which a width is increased in a direction from the intermediate portion to the bottom portion between the intermediate portion and the bottom portion. This configuration is helpful in increasing a solder fillet formation space and sufficiently satisfying impact resistant properties and vibration resistant properties which are demanded in an application in a severe use environment such as an in-vehicle coil apparatus.

Second Embodiment of the Invention

A coil apparatus according to the present invention may be provided with the following technical characteristics in addition to the technical characteristics of the First Embodiment.

That is, the coil apparatus according to the present invention further comprises an insulating sheath body. The insulating sheath body covers the core and a coil provided around the core. The core includes a winding core portion constituted of the winding portion and a pair of flange portions formed at both ends of the winding core portion. A cross section of the winding core portion orthogonal to a winding axis direction has a shape including bulge portions on a pair of opposed surfaces in a square shape.

Preferably, the bulge portion of the winding core portion is constituted of a curved line in the cross section orthogonal to the coil winding axis direction.

Moreover, at least one winding escape portion is formed in the winding core portion, and it is preferable for the winding escape portion to be formed so as to be recessed apart from an arc line which is in contact with the bulge portion and connects the square angular portions on both sides of the bulge portion as seen from a lateral cross section of the winding core portion.

The winding core portion has flat portions on both sides of the bulge portion, and it is preferable for the flat portion to be formed between the other pair of opposed surfaces of the square shape and the bulge portion.

Preferably, a part between the outer peripheral surface of the winding core portion and a surface of the flange portion on the winding core portion side is subjected to R processing or taper machining, and/or a part between the surface of the flange portion on the winding core portion side and the outer peripheral surface of the same on the radial outer side is subjected to R processing.

According to the coil apparatus of the present invention, when the winding of the coil is wound around the winding core portion, the winding is wound in a shape which is closer to a circular shape as seen from the lateral cross section as compared with a case where the bulge portions are not provided. Therefore, even if the coil is expanded due to heat when molding the insulating sheath body, occurrence of concentration of a stress is alleviated at the part of the insulating sheath body which covers the winding at the angular portions in the winding core portion, thereby preventing cracks from being generated in this portion. Additionally, since the bulge portions are formed on a pair of opposed surfaces of the square shape in the lateral cross-sectional shape of the winding core portion, a demand for a reduction in a size of the coil apparatus can be satisfied while preventing cracks from being generated in the insulating sheath body as described above.

Further, when the bulge portion is constituted of a curved line in the lateral cross-sectional shape, it is possible to avoid occurrence of concentration of a stress due to provision of each bulge portion.

Furthermore, in a case where the winding escape portion is formed in the winding core portion, since a part of the winding can enter the winding escape portion when the coil is expanded, and hence a percentage that the expanded winding applies an expansion force to the insulating sheath body on the outer side is lowered, thereby effectively avoiding generation of cracks even around the angular portions of the insulating sheath body where the cracks are a problem in particular.

Moreover, in a case where the flat portions are formed on both sides of the bulge portion, a large compression reactive force can be prevented from acting on an end portion of a mold when manufacturing the winding core portion by compression molding using fine particles. Therefore, a sufficient compression force can be applied, and it is possible to avoid a damage to the mold in a short time.

Additionally, when a connection portion between the winding core portion and the flange portion and/or a connection portion between an outer peripheral surface of the flange portion and a side surface of the winding core portion is subjected to R processing which is larger than a naturally produced conformation in machining, it is possible to avoid generation of cracks at a boundary between the winding core portion and the flange portion or occurrence of fractures or chipping in the flange portion.

Third Embodiment of the Invention

A coil apparatus according to the present invention may be provided with the following technical characteristics in addition to the technical characteristics of the First Embodiment.

That is, the coil apparatus according to the present invention further comprises an insulating covering body. The core includes a coil winding portion, and the coil winding portion extends in a longitudinal direction. The winding is wound around the coil winding portion to constitute a coil. The insulating covering body is formed of a thermoplastic insulating resin, and covers the core and the coil. The core and the coil are positioned at a substantially central part of the insulating covering body.

As described above, the coil apparatus according to the present invention includes the insulating covering body, and the insulating covering body covers the core and the coil. According to this configuration, the insulating covering body can protect the core and the coil, thereby realizing the coil apparatus having excellent reliability.

In the present invention, one of important points is that the core and the coil are positioned at the substantially central part of the insulating covering body. According to such a configuration, the core and the coil are sealed in the insulating covering body so that the core and the coil are prevented from being partially or entirely exposed, and it is possible to realize the coil apparatus having excellent impact resistant properties, vibration resistant properties and high reliability. Further, since a thickness of the insulating covering body can be set to a necessary minimum value, an outside dimension of each of the core and the coil provided inside can be relatively set large with respect to a determined outside dimension of the coil apparatus, thereby obtaining excellent electrical characteristics.

In the present invention, another important point is that the insulating covering body is formed of a thermoplastic insulating resin. When the insulating covering body is formed of a thermoplastic insulating resin material, a variation of an inductance value due to a fluctuation in a temperature can be reduced as compared with a case where the insulating covering body is formed of a thermosetting insulating resin material. It can be considered that an influence of thermal expansion and contraction of the insulating covering body can be alleviated with respect to the core and a thermal stress in the core can be reduced when the insulating covering body is formed of the thermoplastic insulating resin material as compared with a case where it is formed of a thermosetting resin material, thereby demonstrating inherent magnetic characteristics of the core. The insulating covering body is preferably formed of a liquid crystal polymer.

Fourth Embodiment of the Invention

A coil apparatus according to the present invention may be provided with the following technical characteristics in addition to the technical characteristics of the First Embodiment.

That is, the coil apparatus according to the present invention further comprises an insulating resin sheath body. The core is a rod-like body extending in one direction, and has the winding portion in an intermediate portion thereof. The winding is wound around the winding portion.

The insulating resin sheath body covers at least a part of the winding. At least one of the bent portions in the terminal is provided outside the insulating resin sheath body. Furthermore, at least a part of a surface of the insulating resin sheath body is roughened.

As described above, since the insulating resin sheath body covers at least a part of the winding, the winding can be protected by the insulating resin sheath body, thereby realizing the coil apparatus having excellent impact resistant properties and vibration resistant properties. The insulating resin sheath body can cover not only a part of the winding but also all of the winding and a part or all of the core. A covering conformation may be appropriately determined in accordance with an intended purpose and a use environment.

In this manner, since the winding is covered with the insulating resin sheath body, impact resistant properties and vibration resistant properties can be improved, whereas the insulating resin sheath body obstructs radiation of heat generated in the winding. Since an electric resistance value of the winding has temperature dependence, characteristics vary unless heat radiation is facilitated. A change in characteristics due to a temperature is also observed in the core.

Thus, as means for solving this problem, in the present invention, at least a part of a surface of the insulating resin sheath body is roughened. A typical example of roughening is so-called "texturing".

As described above, when the surface of the insulating resin sheath body is roughened, a surface area of the insulating resin sheath body is increased in accordance with a roughened surface area, roughening properties and others. Therefore, heat radiation area is increased to facilitate heat radiation, thereby improving thermal stability of characteristics. It is ideal that the entire surface of the insulating resin sheath body is roughened, but roughening may be partially performed.

Fifth Embodiment of Invention

A coil apparatus according to the present invention may be provided with the following technical characteristics in addition to the technical characteristics of the First Embodiment.

That is, in the coil apparatus according to the present invention, the winding is wound around the winding portion to constitute a coil. The coil includes at least a first coil portion and a second coil portion. A boundary end surface of the first coil portion on the second coil portion side is inclined in such a manner that its inner peripheral side is closer to the second coil portion than its outer peripheral side.

Further, it is preferable for a boundary end surface of the second coil portion on the first coil portion side to be inclined in such a manner that its outer peripheral side is closer to the first coil portion than its inner peripheral side.

According to the coil apparatus of the present invention, when forming a coil based on a divided winding conformation, the winding can be prevented from collapsing without providing a flange to the core. Therefore, elimination of the flange can achieve a reduction in a size of the core or a decrease in a manufacture cost by simplification of a structure.

Furthermore, when the boundary end surface of the second coil portion on the first coil portion side is obliquely formed in such a manner that its outer peripheral side is closer to the first coil portion than its inner peripheral side, a winding region of the winding can be effectively assured. This is also true when the boundary end surface of the second coil portion on the first coil portion side is mounted and formed on the boundary end surface of the second coil portion.

The coil apparatus according to the present invention can be used in many fields. Specific applications are, for example, for an antenna, an antenna or transponder for an in-vehicle device, an inductor or a choke coil of an electronic device, and others.

As described above, according to the present invention, the following effects can be obtained.

(a) It is possible to provide a coil apparatus which can increase mechanical strength of a terminal portion and assure sufficient impact resistant properties and vibration resistant properties even in an application in a severe use environment such as an in-vehicle coil apparatus.

(b) It is possible to provide a coil apparatus which can prevent cracks from being generated in an insulating sheath body while satisfying demands for a reduction in size/a decrease in thickness.

(c) It is possible to provide a coil apparatus which has an increased core size and improved electrical characteristics without deteriorating impact resistant properties, vibration resistant properties and durability obtained by insulative covering.

(d) It is possible to provide a coil apparatus in which a variation in inductance value due to a fluctuation in temperature is reduced.

(e) It is possible to provide a coil apparatus which has increased heat radiation properties and improved thermal stability of characteristics and can assure sufficient thermal stability, impact resistant properties and vibration resistant properties even in an application in a severe use environment such as an in-vehicle coil apparatus.

(f) It is possible to provide a coil apparatus having a divided winding conformation which can prevent a winding from collapsing while reducing a size of a core and simplifying a configuration.

DESCRIPTION OF REFERENCE NUMERALS

Figure 1:
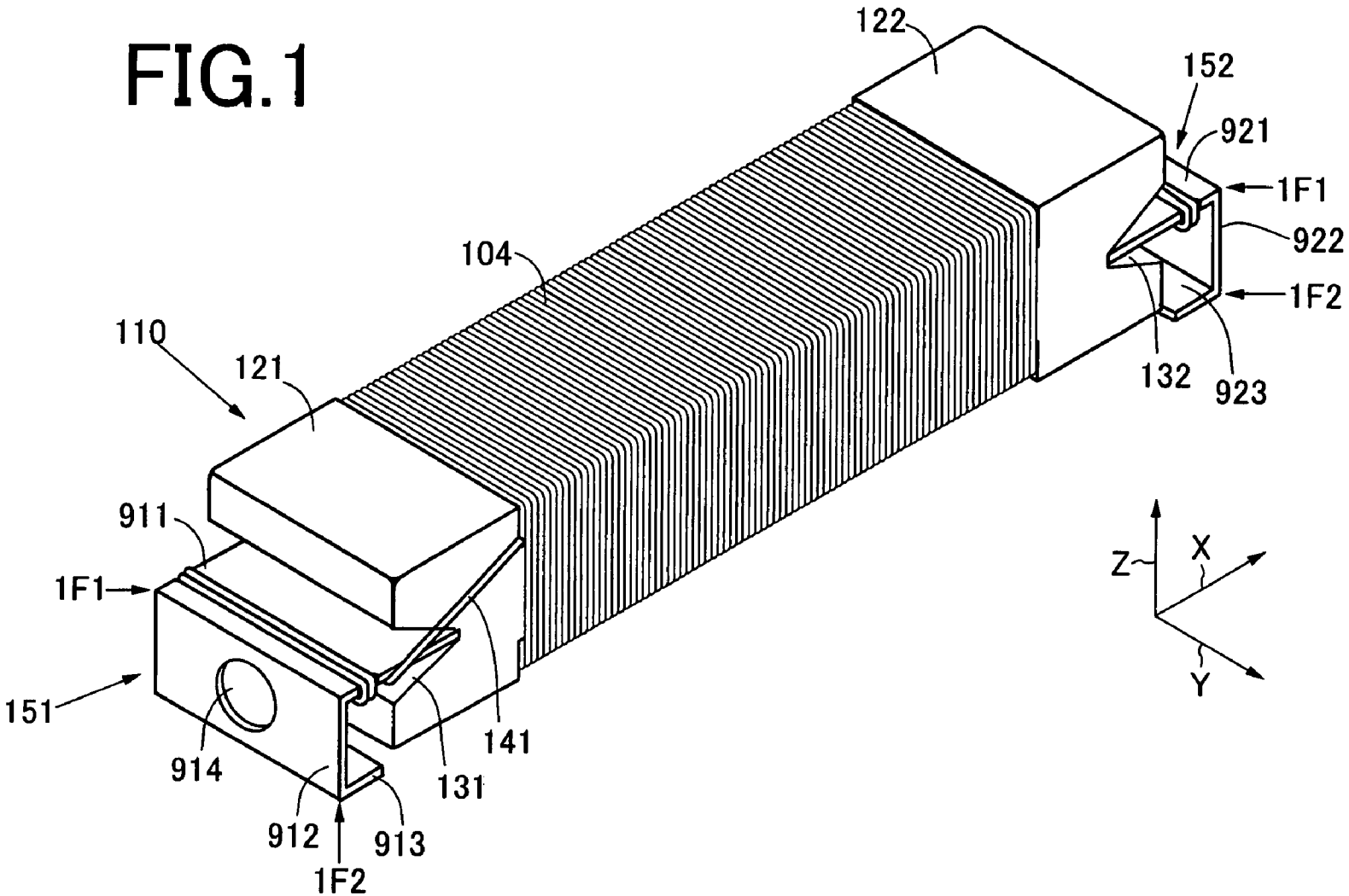
FIG. 1 is a perspective view of a coil apparatus according to an embodiment of the present invention.

101 winding portion
121, 122 terminal attachment portion
131, 132 concave portion
104 winding
151, 152 terminal
911, 921 attachment portion
912, 922 intermediate portion
913, 923 bottom portion
914, 924 hole

BEST MODE FOR CARRYING OUT THE INVENTION

First to fifth embodiments according to the present invention will now be described hereinafter with reference to the accompanying drawings.

First Embodiment of the Invention

Figure 2:
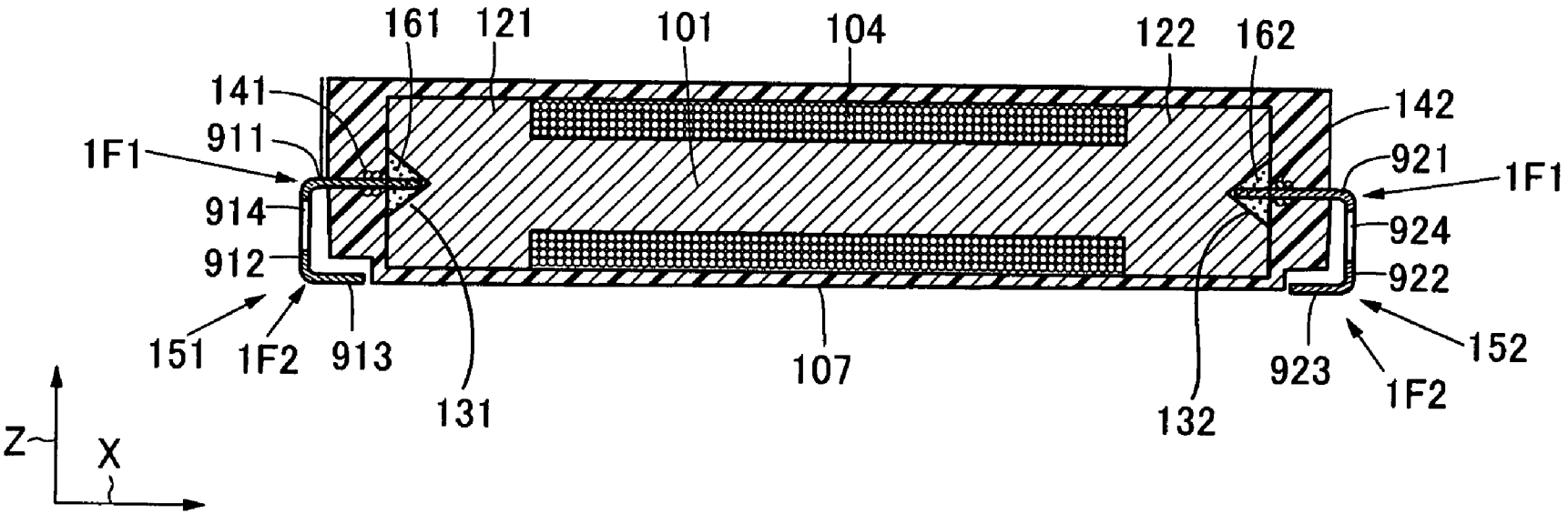
FIG. 2 is a front cross-sectional view of the coil apparatus depicted in FIG. 1.
Figure 3:
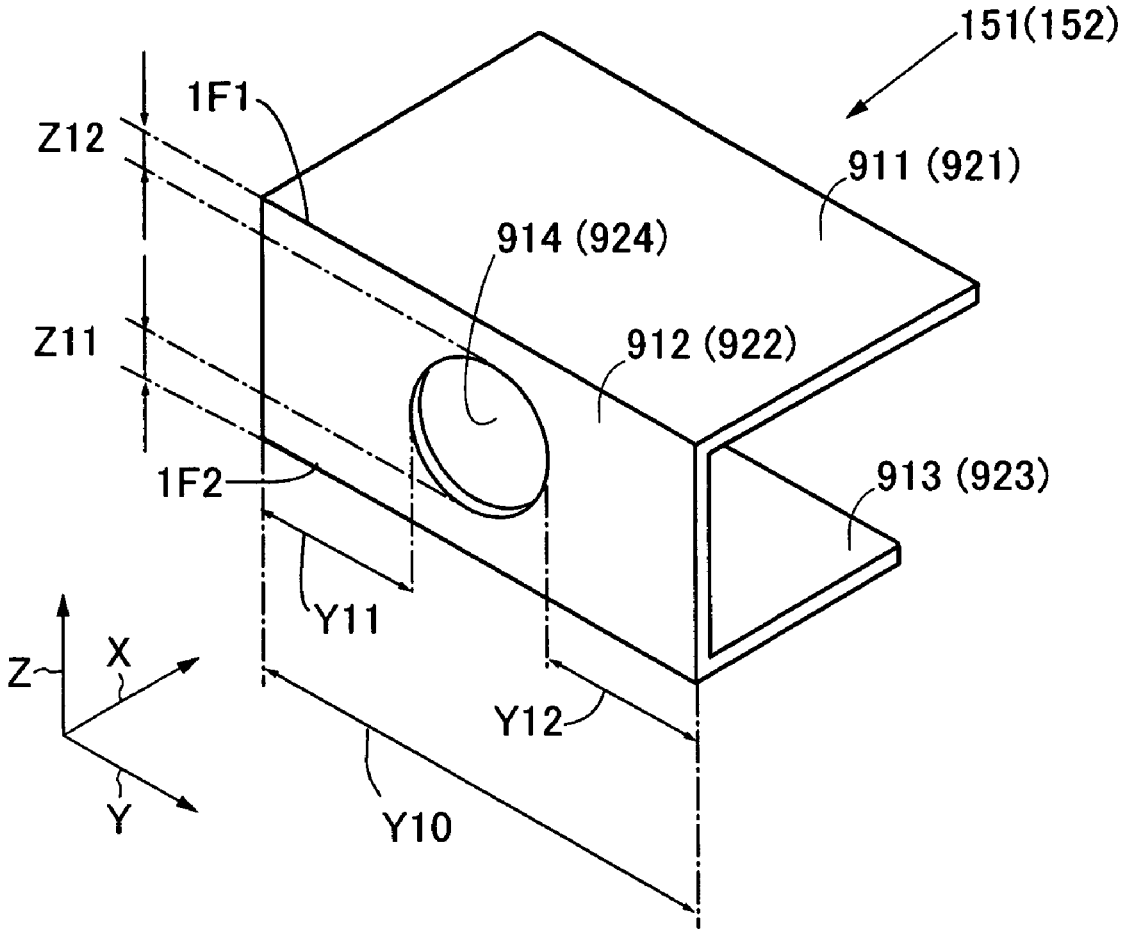
FIG. 3 is a partially enlarged perspective view of the coil apparatus depicted in FIGS. 1 and 2.

FIG. 1 is a perspective view of a coil apparatus according to another embodiment of the present invention, FIG. 2 is a front cross-sectional view of the coil apparatus depicted in FIG. 1, and FIG. 3 is a perspective view showing a terminal used in the coil apparatus depicted in FIGS. 1 and 2. This coil apparatus can be used in, e.g., an antenna, an in-vehicle antenna, a transponder, a choke coil, an inductor of an electronic device and others.

Referring to FIGS. 1 and 2, the coil apparatus includes a core 110, a winding 104 and terminals 151 and 152 and further comprises an insulating resin 107.

The core 110 has terminal attachment portions 121 and 122 at opposed both ends thereof, and has a winding portion 101 in an intermediate portion thereof. The core 110 is typically a ferrite core, and its material is selected in accordance with requested characteristics. The ferrite core can be obtained from a sintered body of ferrite particles or by mechanical processing of a ferrite rod material or by combining the sintered body with mechanical processing.

The winding portion 101 has an elongated shape which extends in a longitudinal direction X. In the illustrated embodiment, the winding portion 101 has a square cross section. Besides, it is possible to accept an arbitrary cross-sectional shape, e.g., any other polygonal cross section, a circular cross section, an elliptic cross section and others.

The terminal attachment portions 121 and 122 are provided at both ends of the winding portion 101 in the longitudinal direction X consubstantially with the winding portion 101, and have concave portions 131 and 132 on outer end surfaces in the longitudinal direction X. Each of the illustrated terminal attachment portions 121 and 122 has a flange-like shape, and its cross section at a position where the concave portion 131 or 132 does not exist has a square shape. It is preferable that an outer edge portion and an inner angular portion of each of the terminal attachment portions 121 and 122 are rounded or slightly chamfered.

Each of the concave portions 131 and 132 has a depth direction matching with the longitudinal direction X, extends in a width direction Y, and has a width which is narrowed toward bottom portion. In the drawing, both inclined surfaces of each of the concave portions 131 and 132 cross each other at the bottom portion, and each concave portion 131 or 132 has a complete V shape in which the depth direction matches with the longitudinal direction X. Besides, each concave portion may have a shape in which a bottom portion is a flat surface or a shape in which the bottom portion is an arc surface. Furthermore, each of the concave portions 131 and 132 is formed along the entire width of each of the terminal attachment portions 121 and 122 in the drawing, but it is possible to accept a structure in which each concave portion is shorter than the entire width and closed at both ends.

The winding 104 is wound around the winding portion 101 of the core 110. The number of times of winding, a wire diameter and others of the winding 104 vary depending on a coil apparatus to be obtained. Each of the terminals 151 and 152 is formed of one bent metal sheet. As a metal sheet material constituting each of the terminals 151 and 152, a non-magnetic material having spring properties, e.g., a phosphor bronze plate, a stainless-based metal sheet such as SUS 304-CSP or the like is suitable.

Each of the terminals 151 and 152 includes a first bent portion 1F1 and a second bent portion 1F2. The first bent portion 1F1 generates an intermediate portion 911 or 921 which is bent in a direction opposed to the outer end surface with a gap therebetween from the attachment portion 911 or 921 which is led in a direction apart from the core 110 along the longitudinal direction X.

The second bent portion 1F2 forms a bottom portion 913 or 923 which is bent in a direction of getting closer to the core 110 along the longitudinal direction X from the intermediate portion 911 or 921. An end of each of the bottom portions 913 and 923, i.e., a free end is positioned on the outer side of the outer end surface of the core 110 as seen in the longitudinal direction X. According to this arrangement, frequency-inductance characteristics and frequency-Q characteristics are improved.

One end of each of the attachment portions 911 and 921 is fixed to each of the terminal attachment portions 121 and 122 of the core 110. Specifically, it is positioned in each of the concave portions 131 and 132 at a fixed position which is determined by a board thickness. Therefore, a position of each of the terminals 151 and 152 with respect to the core 110 is uniquely determined, thereby eliminating a fluctuation in the frequency-inductance characteristics and a fluctuation in the frequency-Q characteristics involved by a change in position of each terminal 151 or 152.

Each of the attachment portions 911 and 921 is fixed in each of the concave portion 131 and 132 by each adhesive 61 or 62 filled in each of the concave portions 131 and 132. In this case, when a notch or the like is provided at one end which is inserted into each concave portion 131 or 132, each adhesive 61 or 62 is filled in the notch, thus improving attachment strength of each terminal 151 or 152 with respect to the core 110. Each winding end 41 or 42 is wound around each attachment portion 911 or 921 for two or three times and preferably joined by Pb free soldering.

Further, the intermediate portion 912 or 922 has a hole 914 or 924 in a plane thereof. In each of the holes 914 and 924, both inner edges opposing in at least one direction have an arc shape.

Each intermediate portion 912 or 922 is a part which faces the end surface of the core 110, and has a relationship that its board surface is orthogonal to or crosses a magnetic flux caused by a current flowing through the winding. Therefore, each intermediate portion can be an obstacle part which obstructs a smooth flow of the magnetic flux, thereby possibly deteriorating the frequency-inductance characteristics and the frequency-Q characteristics. Thus, in the present invention, each hole 914 or 924 is provided in a plane of each intermediate portion 912 or 922.

Since existence of each of the holes 914 and 924 provides a structure in which a cross-sectional area of each intermediate portion 912 or 922 is smaller than cross-sectional areas of each attachment portion 911 or 921 and each bottom portion 913 or 923, and an obstacle with respect to the flow of the magnetic flux is reduced, thus suppressing deterioration in the frequency-inductance characteristics and the frequency-Q characteristics.

Provision of the hole 914 or 924 to the intermediate portion 912 or 922 lowers mechanical strength of the intermediate portion 912 or 922. A reduction in mechanical strength must be suppressed as much as possible. Or else, it becomes hard to assure impact resistant properties and vibration resistant properties required in an application in a severe use environment such as an in-vehicle coil apparatus.

As a countermeasure, in the present invention, both inner edges of the hole 914 or 924 opposing at least in one direction have the arc shape. According to the hole shape, as different from a square hole having acute inner angles, sufficient mechanical strength can be assured, and it is possible to satisfactorily meet impact resistant properties and vibration resistant properties required in an application in a severe use environment such as an in-vehicle coil apparatus. Although it seems that simple technical processing, i.e., changing a square hole to a circular hole is provided, the circular hole is very effective means which demonstrates the maximum effect in a restricted structure.

FIG. 3 is an enlarged perspective view of the terminal. The hole 914 or 924 has a circular shape, and provided in the plane of the intermediate portion 912 or 922. It is preferable that a hole diameter of the hole 914 or 924 is approximately ⅓ of a full width Y10 of the terminal 151 or 152 and spaces having the same widths Y11 and Y12 are generated on right and left sides in the width direction.

Furthermore, it is preferable to arrange the hole 914 or 924 at such a position that a distance Z11 from the second bent portion 1F2 to a hole edge is larger than a distance Z12 from the first bent portion 1F1 to the hole edge as seen from a height direction Z, i.e., that the hole 914 or 924 is biased in a direction of the attachment portion 911 or 921.

The coil apparatus shown in FIGS. 1 and 2 further includes an insulating sheath body 7. The insulating sheath body 7 covers the core 110, the winding 104 and a part of the attachment portions 911 and 921 of the terminals 151 and 152. According to this configuration, the insulating sheath body 7 can protect the core 110 and the winding 104, and coupling strength of the terminals 151 and 152 with respect to the core 110 can be improved, thereby realizing the coil apparatus having excellent mechanical reliability.

Figure 4:
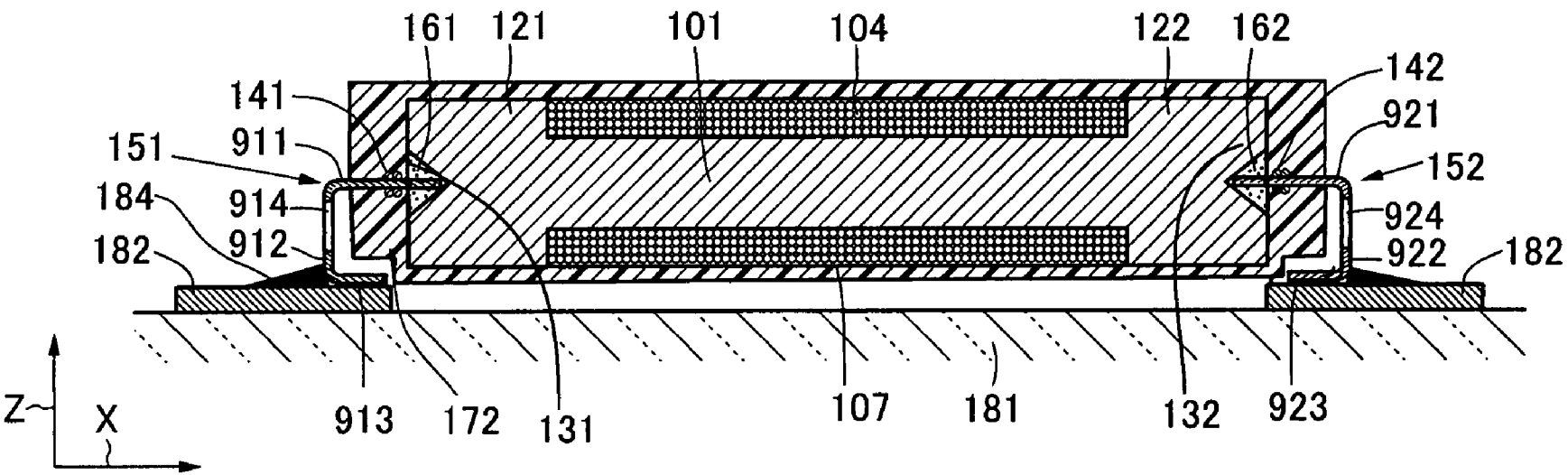
FIG. 4 is a view showing a use state of the coil apparatus depicted in FIGS. 1 to 3.

FIG. 4 is a view showing a use state of the coil apparatus depicted in FIGS. 1 and 2. As shown in the drawing, in the use state, the bottom portions 913 and 923 are soldered on each conductor pattern 182 provided to a circuit substrate 181. The coil apparatus is attached in such a manner that a gap is produced between a lower surface of the insulating sheath body 17 and a surface of the circuit substrate 181.

Since the terminal 151 or 152 has the first bent portion 1F1 and the second bent portion 1F2, impact shocks and vibrations can be absorbed by spring properties provided by the first and second bent portions 1F1 and 1F2. Therefore, the coil apparatus having excellent impact resistant properties and vibration resistant properties can be realized.

Moreover, in case of the coil apparatus shown in FIGS. 1 and 2, since the hole diameter of the hole 914 or 924 is set to approximately ⅓ of the full width Y10 of the terminal 151 or 152 so that the spaces having the same width Y11 and Y12 are formed on the right and left sides in the width direction, a solder fillet formation space can be increased on each of right and left sides of the hole 914 or 924 in the width direction, thus increasing strength provided by the soldering 84.

Additionally, since the hole 914 or 924 is arranged at such a position that the distance Z11 from the second bent portion 1F2 to the hole edge is larger than the distance Z12 from the first bent portion 1F1 to the hole edge as seen from a height direction Z, i.e., that the hole 914 or 924 is biased in the direction of the attachment portion 911 or 921, the solder fillet formation space can be increased on the lower side of the hole 914 or 924, thereby increasing strength of the soldering 84.

The hole 914 or 924 formed in the intermediate portion 912 or 922 can take various conformations as long as the above-described requirements are satisfied. Such examples will now be described with reference to FIGS. 5 to 10.

Figure 5:
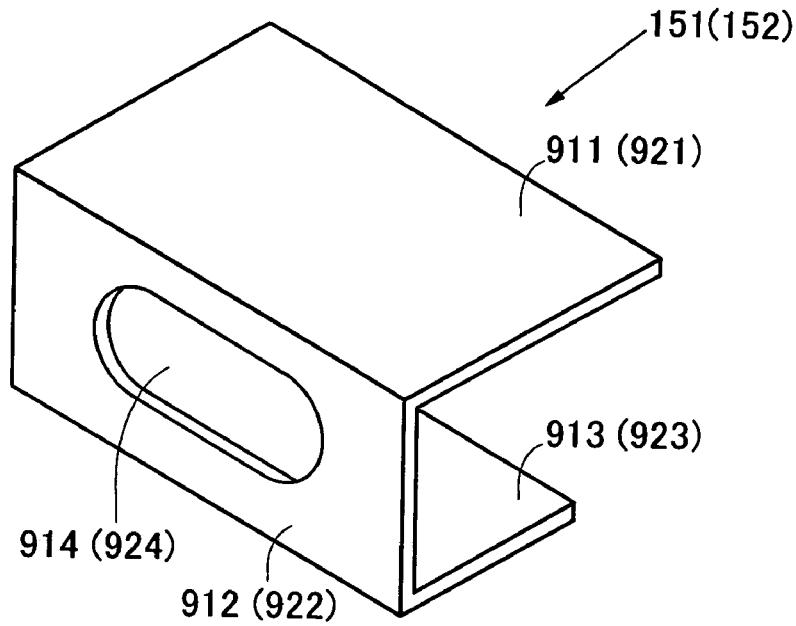
FIG. 5 is a perspective view showing another conformation of a terminal used in the coil apparatus according to the present invention.

First, in an example shown in FIG. 5, the hole 914 or 924 has a short diameter and a long diameter, and a direction of the short diameter matches with a height direction Z from the attachment portion 911 or 921 to the bottom portion 913 or 923.

Figure 6:
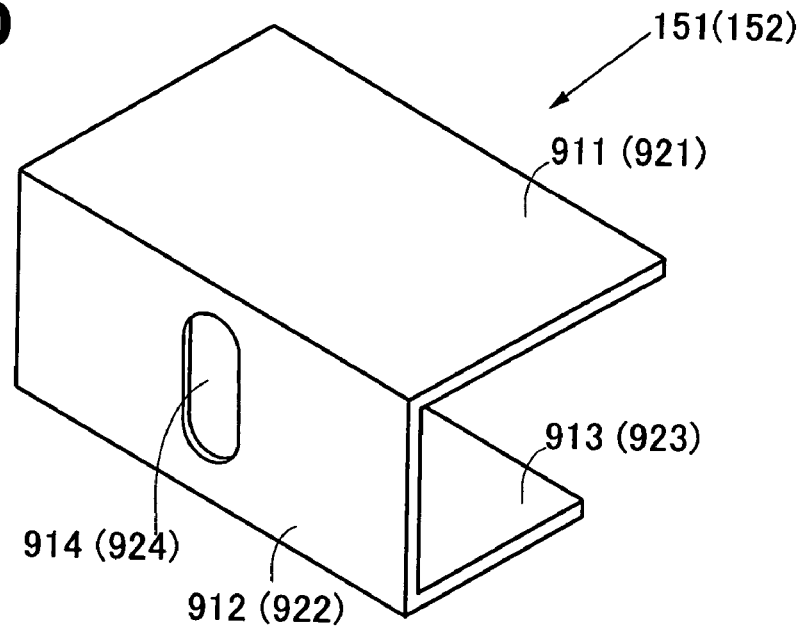
FIG. 6 is a perspective view showing still another conformation of the terminal used in the coil apparatus according to the present invention.

Next, although an example shown in FIG. 6 is an example of a non-circular shape likewise having a short diameter and a long diameter, it is different from the embodiment shown in FIG. 5 in that a direction of the long diameter matches with the height direction Z from the attachment portion 911 or 921 to the bottom portion 913 or 923.

Figure 7:
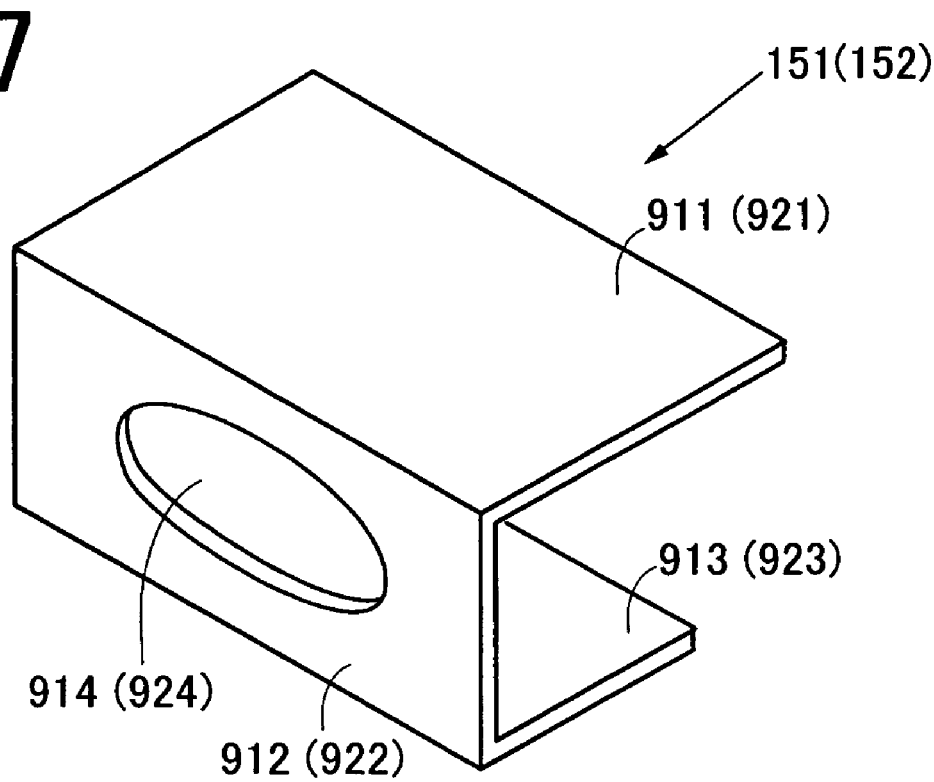
FIG. 7 is a perspective view showing yet another conformation of the terminal used in the coil apparatus according to the present invention.

Although each of the examples shown in FIGS. 5 and 6 is a so-called track shape in which arc-like parts at both ends are continuous to each other through linear parts, an elliptic shape may be accepted as shown in FIG. 7.

Figure 8:
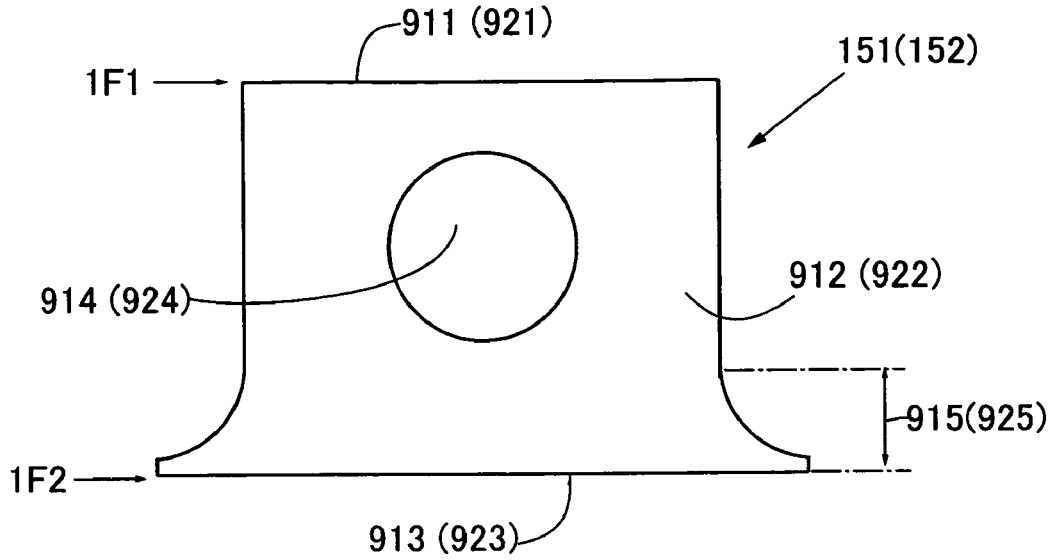
FIG. 8 is a perspective view showing a further conformation of the terminal used in the coil apparatus according to the present invention.

FIG. 8 is a view showing another example of the terminal, and the terminal 151 or 152 has an extended width portion 915 or 925 whose width is extended from the intermediate portion 912 or 922 in a direction of the bottom portion 913 or 923 between the intermediate portion 912 or 922 and the bottom portion 913 or 923.

Figure 9:
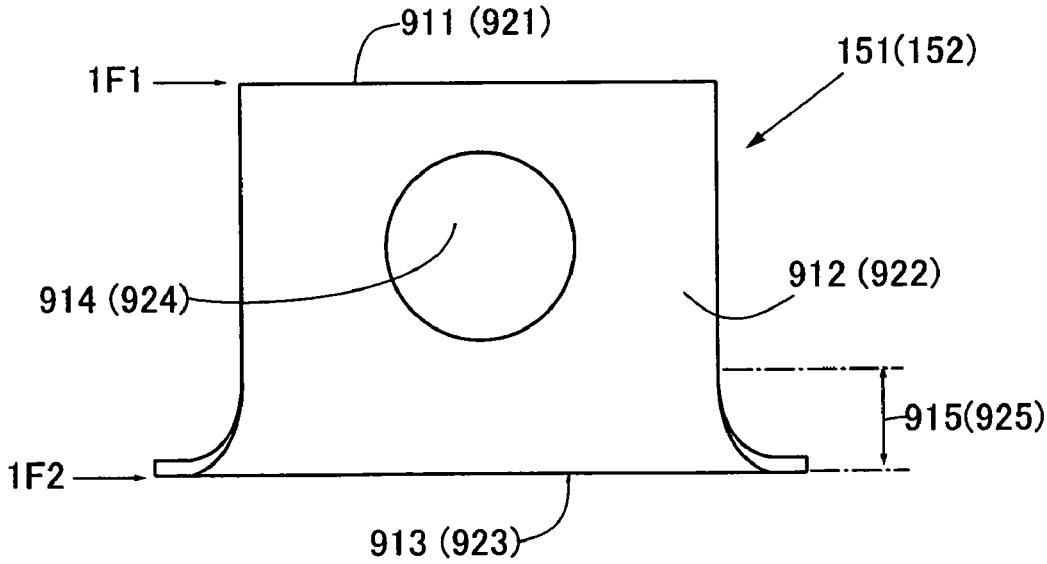
FIG. 9 is a perspective view showing a still further conformation of the terminal used in the coil apparatus according to the present invention.

FIG. 9 is a view showing still another example of the terminal and equal to the example of FIG. 8 in that the extended width portion is provided, but different from the same in a bent position.

Figure 10:
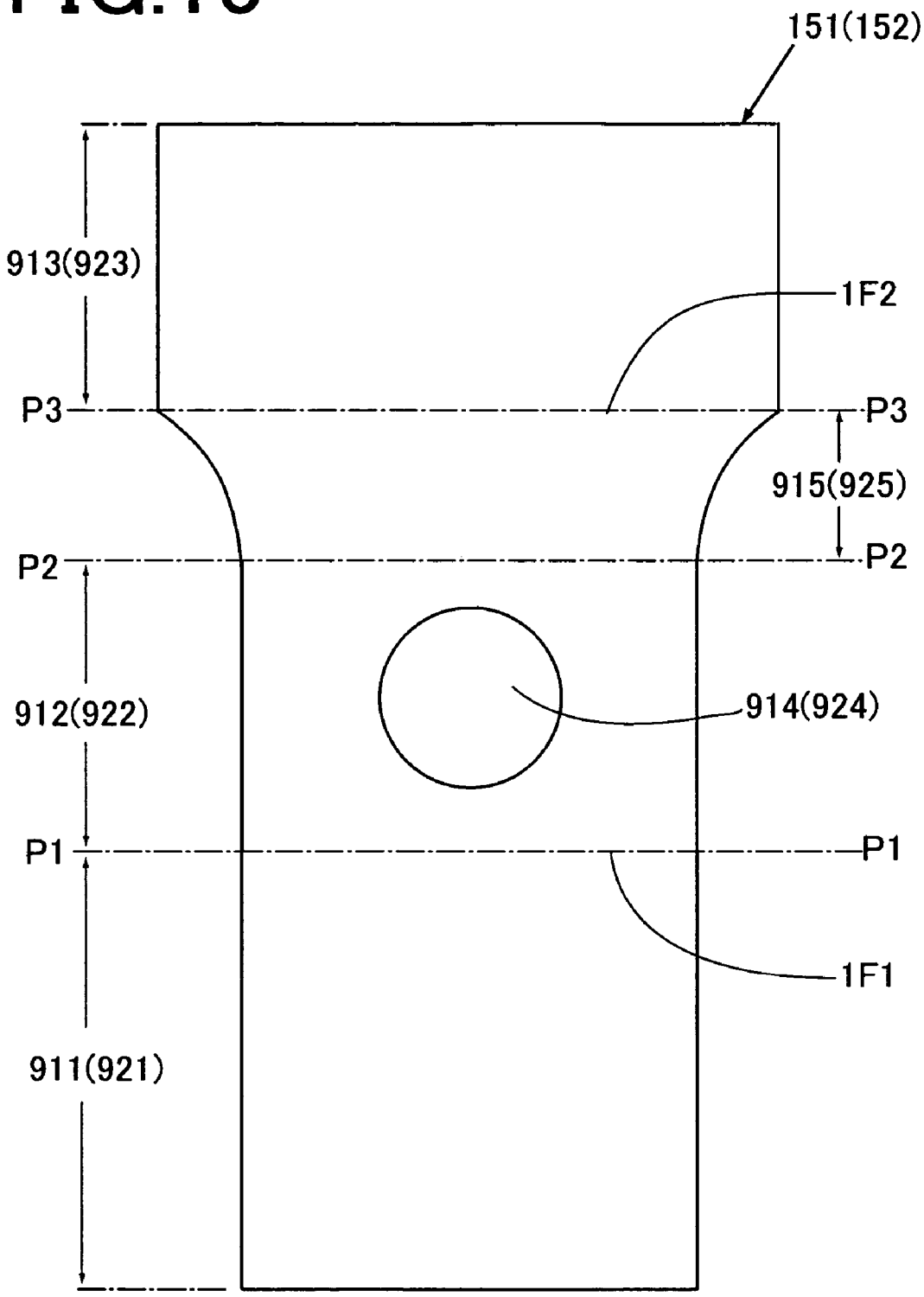
FIG. 10 is a development elevation of the terminal depicted in FIGS. 8 and 9.
Figure 16:
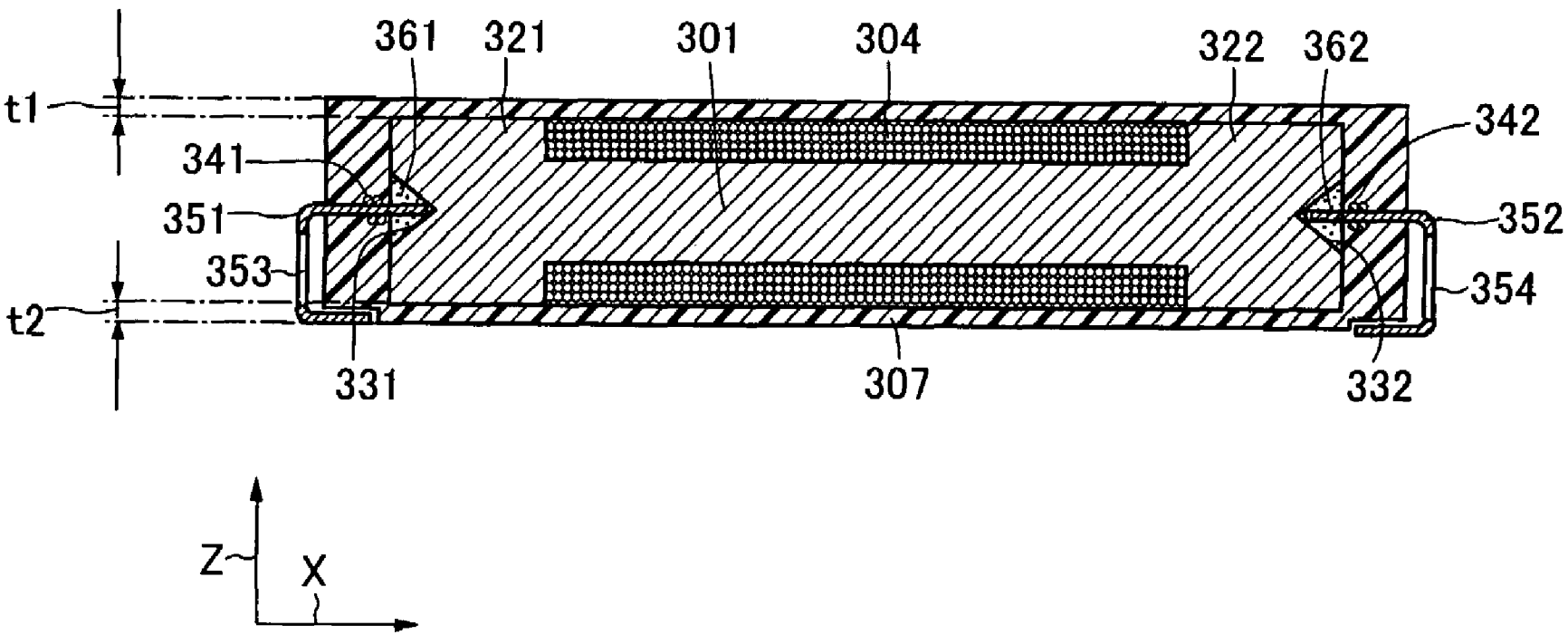
FIG. 16 is a cross-sectional view of a coil apparatus according to a still further embodiment of the present invention.

This point will now be described with reference to FIG. 10. FIG. 10 is a plan development elevation of the terminal. In FIG. 16, each attachment portion 911 or 921 has substantially the same width as that of each intermediate portion 912 or 922, and each bottom portion 913 or 924 has a width larger than the former width. There is an extended width portion 915 or 925 between the intermediate portion 912 or 922 and the bottom portion 913 or 924.

In order to obtained the FIG. 8 type terminal, the second bent portion 1F2 is set in the vicinity of a boundary P4 between the bottom portion 913 or 923 and the extended width portion 915 or 925 in FIG. 10. In order to obtain the FIG. 9 type terminal, it is good enough to set the second bent portion 1F2 in the extended width portion 915 or 925, i.e., between boundaries P2 and P3 in FIG. 10.

According to the terminals shown in FIGS. 8 and 9, the solder fillet formation space can be increased by the extended width portion 915 or 925, and it is possible to satisfactorily meet impact resistant properties and vibration resistant properties required in an application in a severe use environment, e.g., an in-vehicle coil apparatus.

Figure 11:
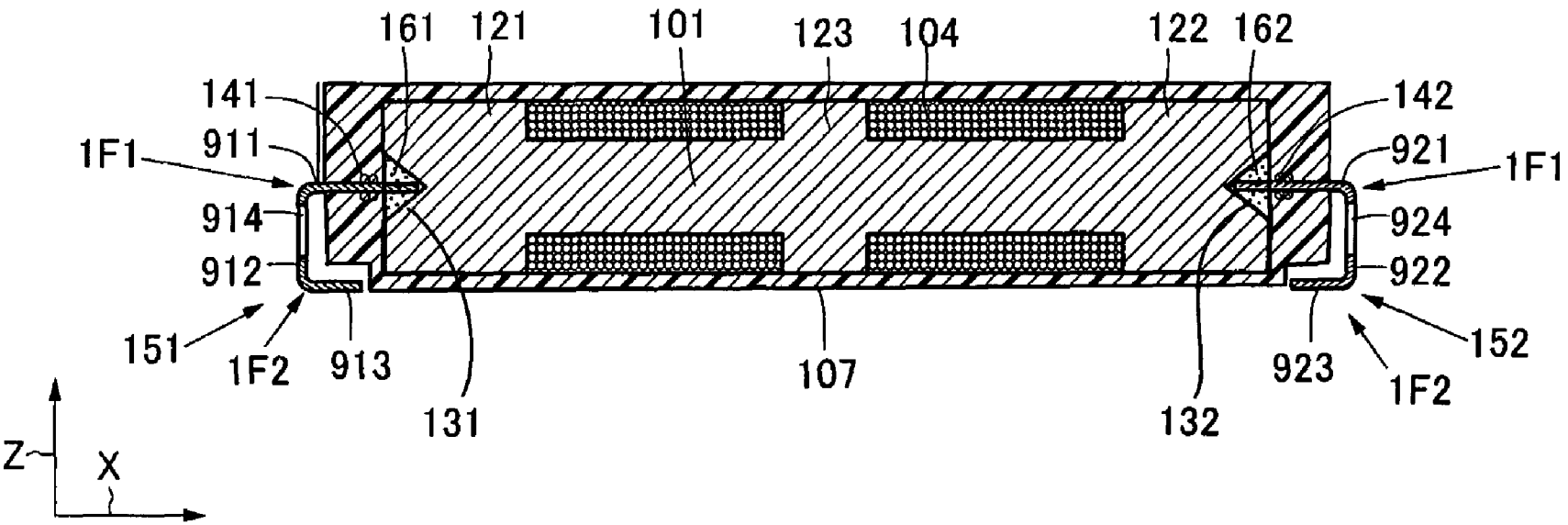
FIG. 11 is a cross-sectional view of a coil apparatus according to another embodiment of the present invention.

FIG. 11 is a cross-sectional view of a coil apparatus according to another embodiment of the present invention. In the drawing, like reference numerals denote parts corresponding to the constituent parts shown in FIGS. 1 and 2, thereby eliminating the tautological explanation. In this embodiment, a core 110 has a partition portion 123 in an intermediate portion thereof, and a winding 104 is provided on both sides of the partition portion 123. That is, a winding portion 101 is divided into a plurality of portions. The winding 104 is continuously wound in the same direction in the divided winding portions 101. This embodiment also demonstrates the same functions and effects as those of the embodiment shown in FIGS. 1 and 2.

Second Embodiment of the Invention

A second embodiment of the present invention will now be described with reference to the accompanying drawings. It is to be noted that like reference numerals denote like or corresponding parts in the drawings.

Figure 12:
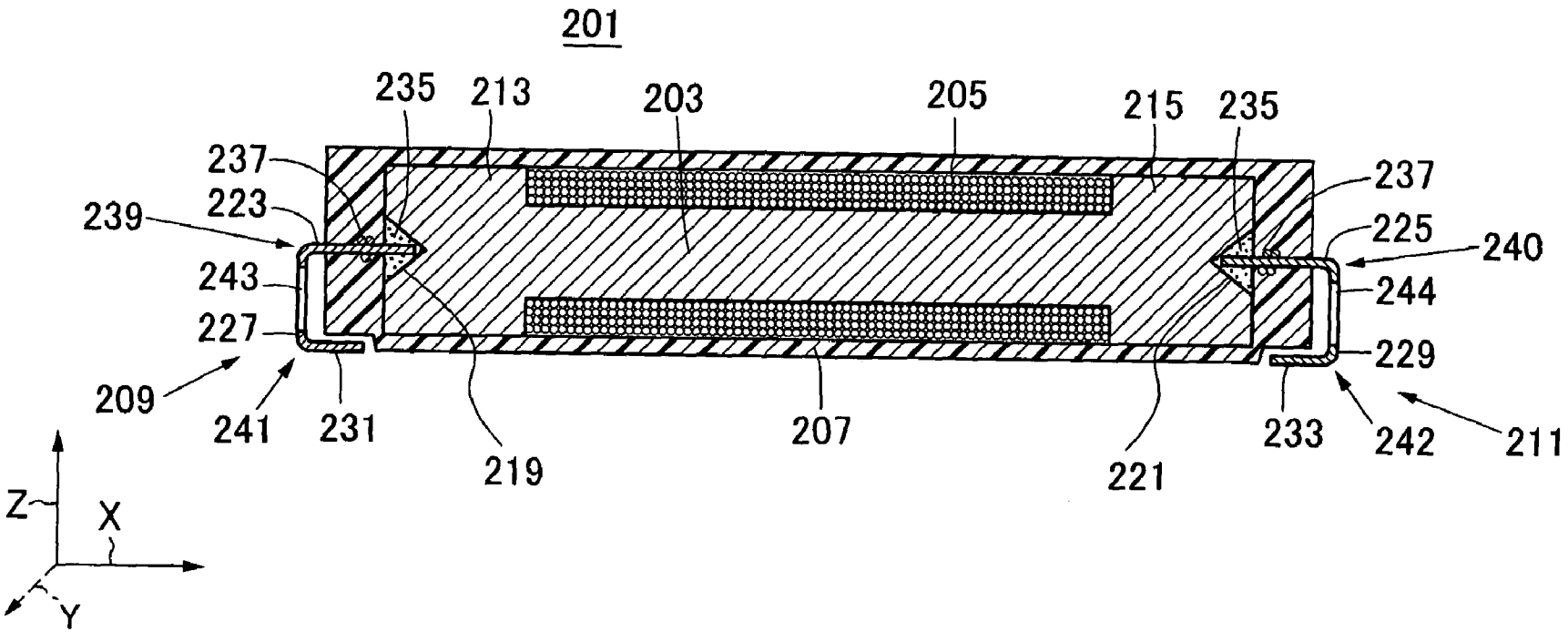
FIG. 12 is a vertical cross-sectional view of the coil apparatus according to a further embodiment of the present invention.

FIG. 12 shows a vertical cross section of a coil apparatus according to a further embodiment of the present invention. A coil apparatus 201 mainly comprises a ferrite core 203, a coil 205, an insulating sheath body 207 and a pair of terminals 209 and 211. Moreover, the coil apparatus 201 is applied to, e.g., a bi-directional keyless entry system which requires no button operation, an antitheft immobilizer, a tire air pressure monitoring system in an automobile.

The coil 205 is formed of a winding which is wound on an outer peripheral surface of the ferrite core 203 with the ferrite core 203 at the center. The insulating sheath body 207 is provided to cover the entire surfaces of the ferrite core 203 and the coil 205.

Figure 13:
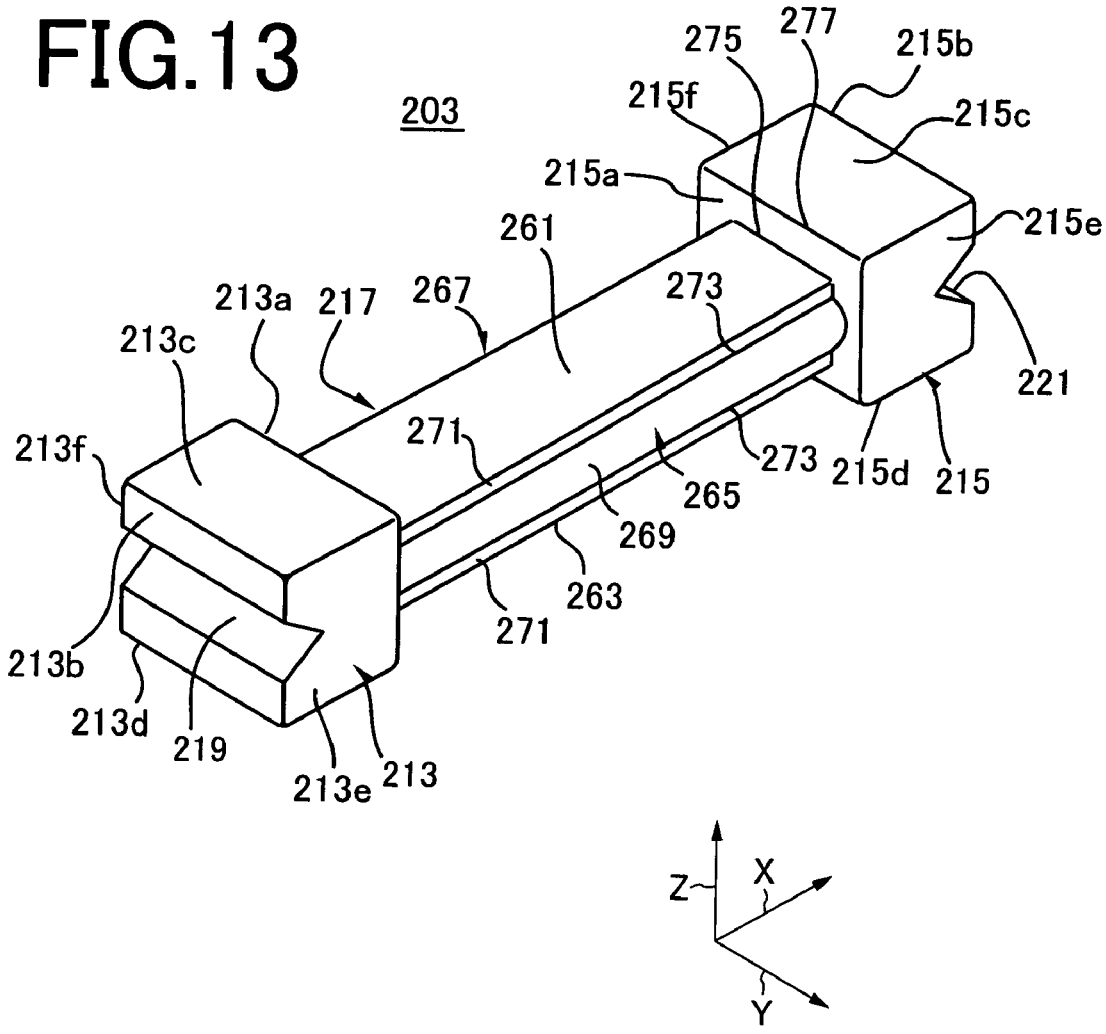
FIG. 13 is a perspective view of a ferrite core in the coil apparatus.
Figure 14:
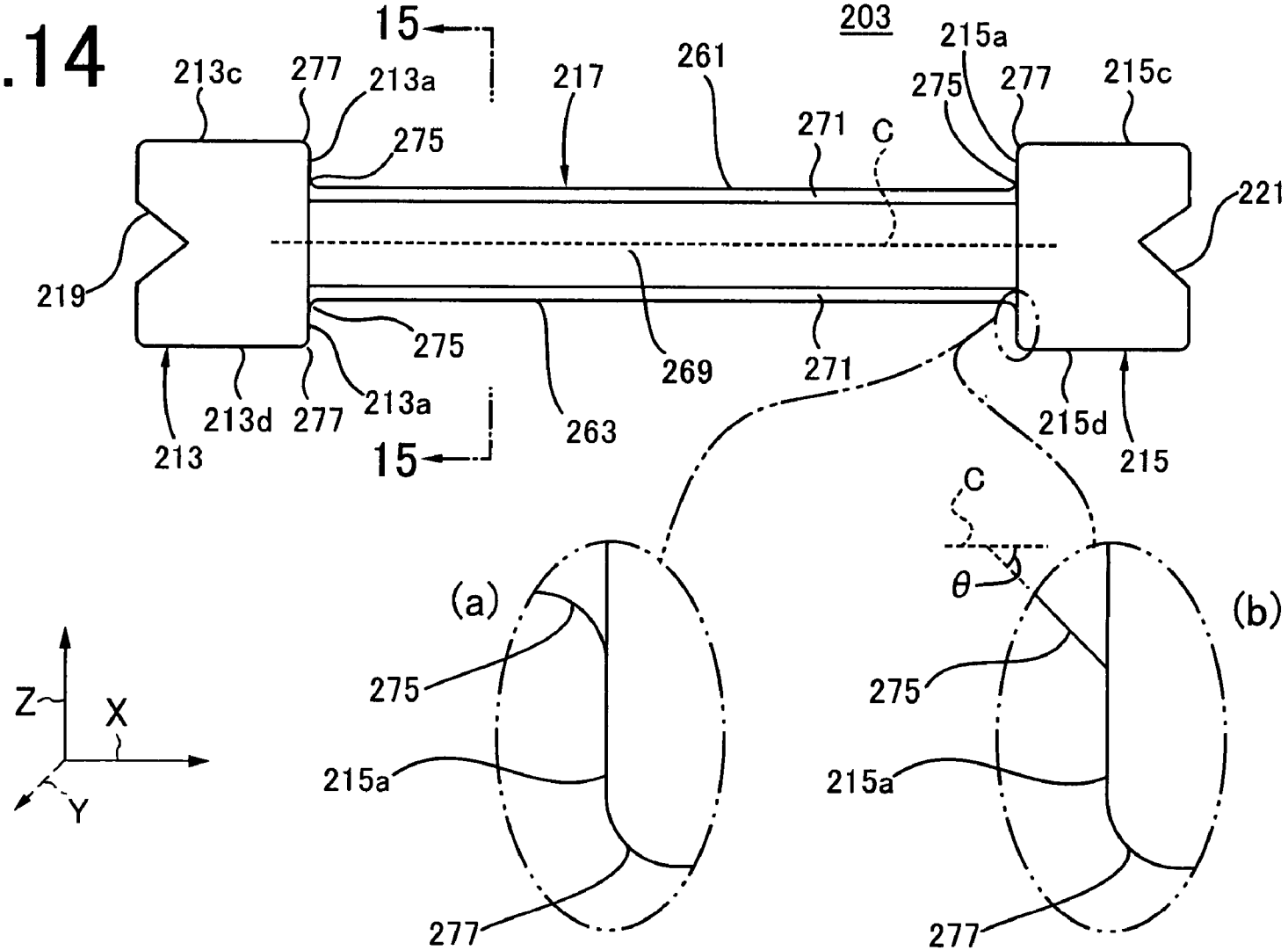
FIG. 14 is a side view of the ferrite core in the coil apparatus.

As shown in FIGS. 13 and 14, the ferrite core 203 is substantially a rod-like member, has flange portions 213 and 215 at both end portions in its longitudinal direction (an X direction), and has a winding core portion 217 between the flange portions 213 and 215.

A pair of V-shaped grooves 219 and 221 are formed on outer end surfaces 213*b* and 215*b* opposite to winding core portion side surfaces 213*a* and 215*a* of the pair of flange portions 213 and 215. The pair of grooves 219 and 221 extend along a Y direction and are opened on both end surfaces of the ferrite core 203 in the Y direction.

The pair of corresponding terminals 209 and 211 are engaged with the pair of grooves 219 and 221. Again referring to FIG. 12, each of the pair of terminals 209 and 211 is a metallic tabular member which is curved in a substantially-U-like shape as seen from a ZX vertical cross section. More specifically, it is possible to use a non-magnetic material having spring properties, e.g., a phosphor bronze plate or a stainless-based metal sheet such as SUS 304-CSP.

Each of the pair of terminals 209 and 211 has three planar portions formed by bending the tabular member at two positions. Of the three planar portions, a first portion (an attachment portion) 223 or 225 and a third portion (a bottom portion) 231 or 233 extend along an XY plane, and a second portion (an intermediate portion) 227 or 229 extends along an YZ plane. The first portion 223 or 225 pierces the insulating sheath body 207. One end of the first portion 223 or 225 is inserted into a corresponding one of the pair of grooves 219 and 221, and fixed by an adhesive 235. Additionally, a winding end 237 of the coil 205 is joined to the first portion 223 or 225 by soldering. The other end of the first portion 223, 225 is connected with a first curved portion (a first bent portion) 239, 240, respectively.

The second portion 227 or 229 extends between the first curved portion 239, 240 and a second curved portion (a second bent portion) 241, 242. Further, a through hole 243 or 244 is formed in the second portion 227 or 229 in order to reduce a cross-sectional area of the second portion 227 or 229 to be smaller than those of the first portion 223 or 225 and the third portion 231 or 233. The third portion 231 or 233 extends from the second curved portion 237 toward the center in the core longitudinal direction in substantially parallel with a lower surface of the insulating sheath body 207.

The insulating sheath body 207 is a substantially rectangular parallelepiped member which covers the ferrite core 203 and the coil 205. That is, like the existing surface mount type coil apparatus, a cross-sectional shape of the insulating sheath body 207 orthogonal to the coil winding axis direction (the X direction) is a square shape. This insulating sheath body 207 can protect the ferrite core 203 and the coil 205, and joining strength of the pair of terminals 209 and 211 with respect to the ferrite core 203 can be improved, thereby improving a structure having excellent mechanical reliability.

Particulars of the ferrite core 203 will now be described with reference to FIGS. 13, 14 and 15. Each of the pair of flange portions 213 and 215 and the winding core portion 217 has a dimension in the Y direction formed to be larger than a dimension in the Z direction. Furthermore, the dimension in the Z direction and the dimension in the Y direction of each of the pair of flange portions 213 and 215 are formed to be larger than those of the winding core portion 217. As a result, in the pair of flange portions 213 and 215, each of the winding core portion side surfaces 213*a* and 215*a* exists in such a manner that it substantially vertically rises from a vertical surface and both side surfaces of the winding core portion 217.

Each of the pair of flange portions 213 and 215 is formed into a substantially rectangular parallelepiped shape, and has the winding core portion side surface 213*a* or 215*a*, an outer end surface 213*b* or 215*b* facing the surface 213*a* or 215*a*, an outer peripheral surface connecting corresponding sides of the surface 213*a* or 215*a* and the surface 213*b* or 215*b*, i.e., an upper surface 213*c* or 215*c*, a lower surface 213*d* or 215*d*, and a pair of side surfaces 213*e* and 213*f* or 215*e* and 215*f*.

Figure 21:
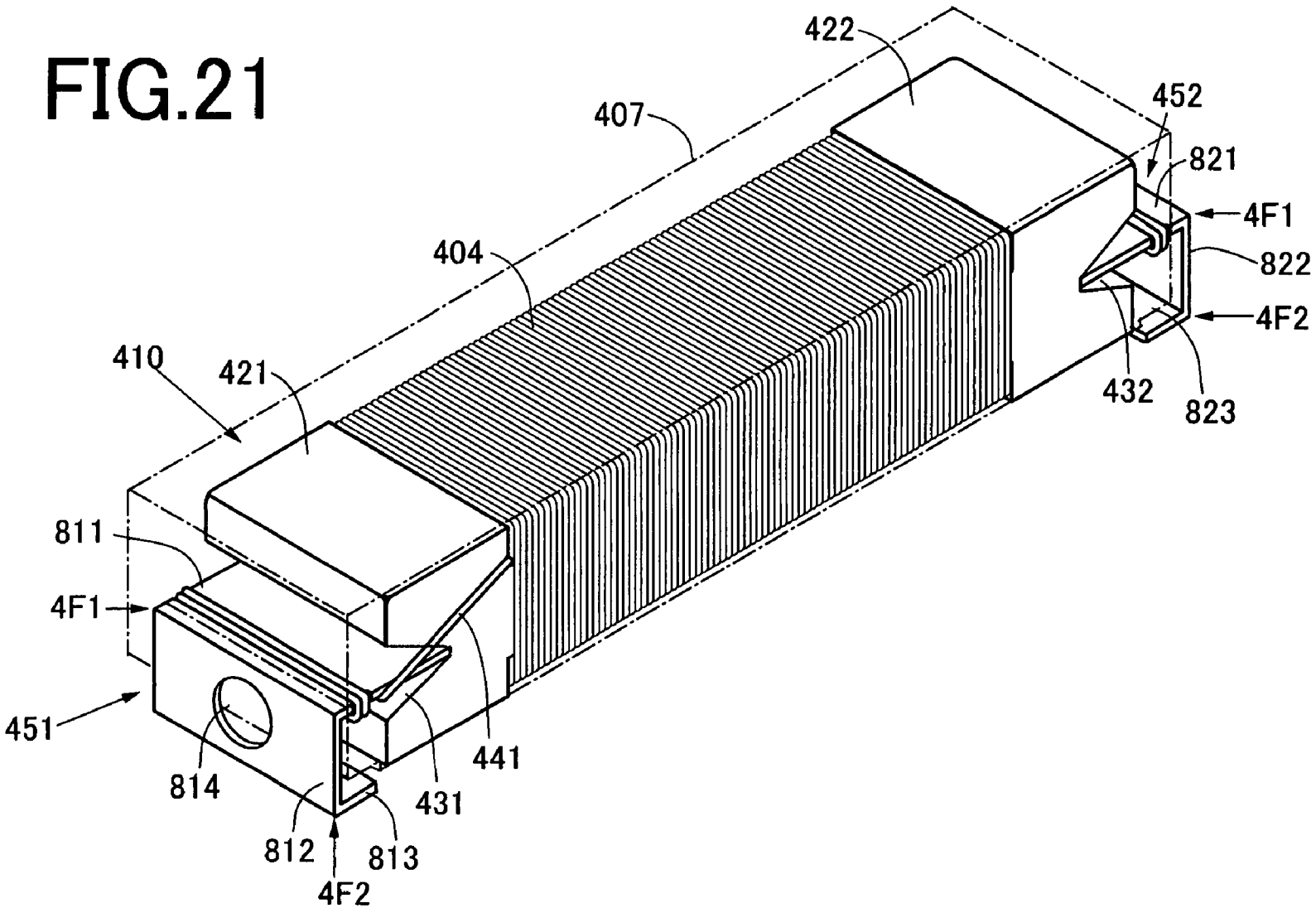
FIG. 21 is a perspective view in which an insulating resin sheath body is eliminated in order to show an internal configuration of the coil apparatus depicted in FIG. 20.

The winding core portion 217 is provided between the pair of flange portions 213 and 215, and has an upper surface 261, a lower surface 263 and a pair of side surfaces 265 and 267. As shown in FIG. 21 in particular, a lateral cross section of the winding core portion 217, i.e., a cross section orthogonal to an axial center direction (the X direction) of the winding core portion 217 has a shape including bulge portions 269 on a pair of opposing surfaces in a square shape indicated by dotted lines.

As a result, in this embodiment, each of the pair of side surfaces 265 and 267 is constituted of the bulge portion 269 and a pair of flat portions 271 formed on both sides of the bulge portion 269. In other words, the pair of flat portions 271 are formed between the bulge portion 269 and the pair of opposing surfaces, i.e., the upper surface 261 and the lower surface 263.

Figure 15:
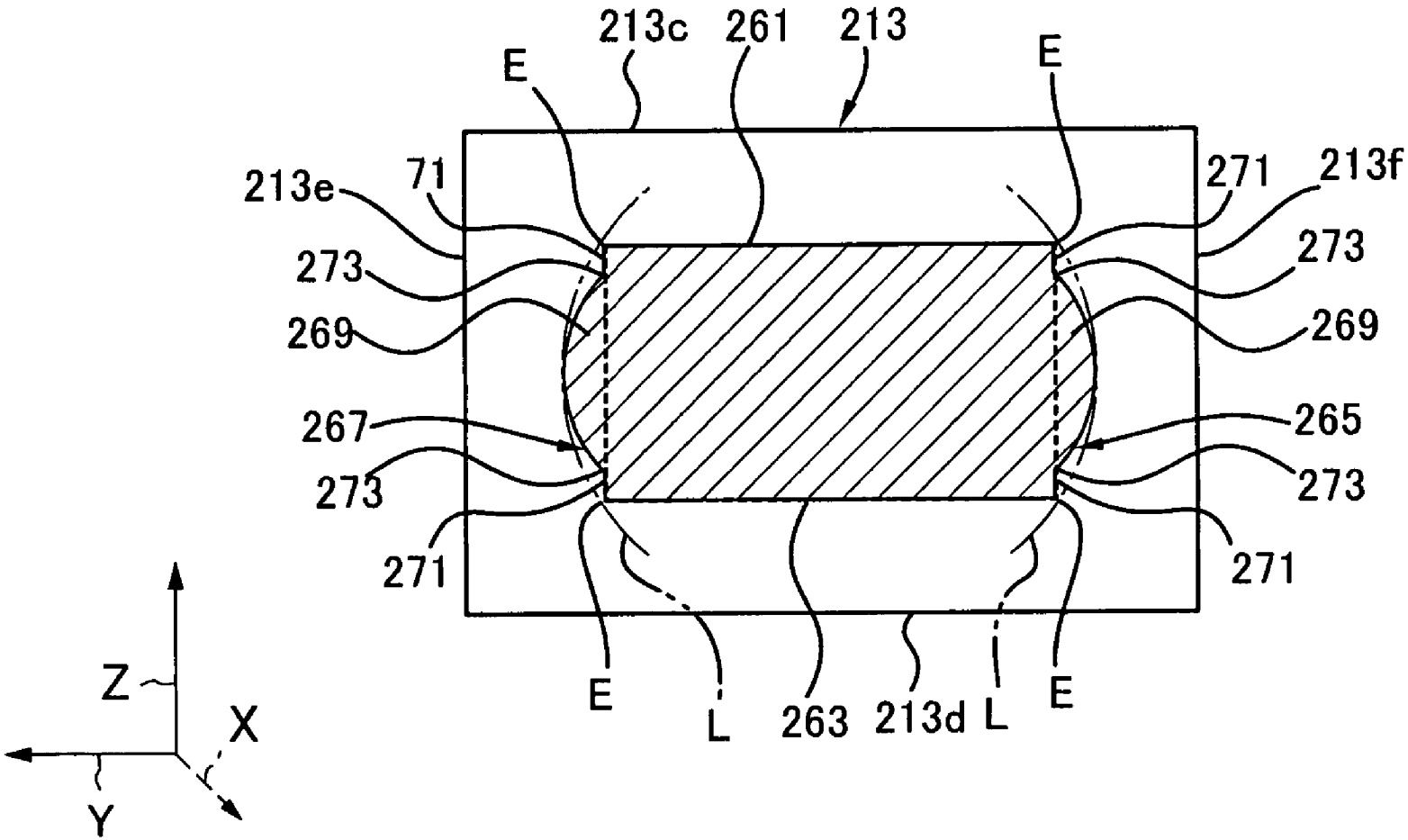
FIG. 15 is a cross-sectional view taken along a line 15-15 in FIG. 14.

Furthermore, each of the pair of bulge portions 269 is formed of a curved line as seen from the lateral cross section in FIG. 15, and formed of an arc-like curved line in particular in this embodiment. Moreover, four winding escape portions 273 are provided to the winding core portion 217. Each winding escape portion 273 is formed by being inwardly depressed apart from a later-described virtual arc line L as seen from the lateral cross section in FIG. 15. The arc line L is a virtual line which is in contact with the bulge portion 269 and connects angular portions E of the square shape positioned on both sides of the bulge portion 269.

Additionally, a connection portion 275 between the upper surface 261 of the winding core portion 217 and each of the winding core portion side surface 213*a* or 215*a* of the pair of flange portions 213 and 215 is subjected to R processing as shown in an enlarged part (a) in FIG. 14 or taper machining as shown in an enlarged part (b) in FIG. 14. Further, a connection portion 277 between each of the winding core portion side surfaces 213*a* and 215*a* of the pair of flange portions 213 and 215 and each of the upper surfaces 213*c* and 215*c* is also subjected to R processing.

Incidentally, in regard concrete dimensions in this embodiment, an X-direction dimension of the winding core portion 217 is 7 mm, the X-direction dimension of the flange portion 213 or 215 is 1.3 mm, and a Z-direction rising dimension of the winding core portion side surface 213*a* or 215*a* of the flange portion 213 or 215 from the winding core portion 217 is 0.5 mm. In such a configuration, when the connection portion 275 is subjected to R processing, a radius of an R-processed part in the connection portion 275 or 277 is 0.215 mm. It is to be noted that a radius of a naturally R-processed part which has been naturally formed before applying R processing according to this embodiment is approximately 0.05 to 0.07 mm. Therefore, a radius of the R-processed part of the connection portion 275 or 277 has a value which is approximately two to three times that of the naturally R-processed part. On the other hand, when the connection portion 275 is subjected to taper machining, an inclination angle θ of a taper-machined part of the connection portion 275 is set to 30 to 60° with respect to a winding axis C of the winding core portion 217.

Furthermore, the winding core portion 217 of the ferrite core 203 is manufactured by a known mode, i.e., press molding which compresses ferrite particles. Press molding is performed by using a pair of mold forms, an upper mold and a lower mold. The pair of mold forms are arranged with a predetermined gap therebetween, ferrite particles are filled between the pair of mold forms, and the ferrite particles are compressed and molded by the upper mold and the lower mold inserted between the pair of mold forms from upper and lower directions. The upper surface 261 and the lower surface 263 of the winding core portion 217 are formed by the pair of mold forms, and the pair of side surfaces 265 and 267 of the winding core portion 217 are molded by the upper mold and the lower mold.

The coil apparatus having the above-described configuration can obtain the following functions. The bulge portions 269 are formed on the pair of opposing side surfaces of the winding core portion 217. Therefore, when the winding of the coil 205 is wound around the winding core portion 217, the winding is wound in a shape which is close to a circular shape as seen in the lateral cross-sectional shape of FIG. 15 as compared with an example where no bulge portion is provided. Therefore, even if the coil 205 is expanded due to heat generated when subjecting the insulating sheath body 207 to molding, it is possible to alleviate concentration of a stress at the part of the insulating sheath body 207 which covers the winding at the angular portions E in the winding core portion 217 and prevent cracks from being produced at these portions.

In particular, when the present invention is carried out as an in-vehicle transponder, since the number of times of winding of the coil 205 is increased, a rate of winding expansion is high, and a rate of occurrence of cracks is increased. Therefore, the present invention is particularly effective when carried out as an in-vehicle transponder.

Moreover, since the bulge portion 269 is constituted of a curved line in the lateral cross-sectional shape, provision of the bulge portion 269 can prevent stress concentration from being newly generated.

Additionally, as described above, when an insulating sheath body having a square lateral cross-sectional shape like an existing surface mount type coil apparatus is utilized and a winding core portion having a circular lateral cross-sectional shape is also used, there is a tendency that a wall thickness of the insulating sheath body is hard to be assured or a size of the entire coil apparatus is increased. However, in the present invention, the lateral cross-sectional shape of the winding core portion is formed to include the bulge portions on the pair of opposing surfaces in the square shape when providing the bulge portions 269, and hence a demand for a reduction in size of the coil apparatus can be satisfied while avoiding occurrence of cracks in the insulating sheath body 207 as described above. In particular, when the pair of side surfaces on which the bulge portions 269 are provided are arranged in accordance with the lateral direction at the time of mounting, a reduction in thickness (a reduction in height) of the coil apparatus can be achieved.

Additionally, since the winding escape portions 273 are formed in the winding core portion 217, when the coil 205 is expanded due to heat generated when molding the insulating sheath body 207 as described above, a part of the winding can enter the winding escape portions 273, namely, it can be expanded on the inner side apart from the arc line L. Therefore, a rate of applying an expansion force of the expanded winding to the outer insulating sheath body 207 can be lowered, and occurrence of cracks can be effectively avoided in the vicinity of the angular portions of the insulating sheath body 207 where cracks become a problem.

Further, since the winding core portion 217 is manufactured by compression molding of particles as described above, usually, when the winding core portion has an arc-like outer shape as seen in the lateral cross section, there is a problem that the two adjacent molds come into contact with each other at an acute angle and a sufficient compression force cannot be applied, or a damage to the molds becomes prominent. That is, if the bulge portions of the winding core portion 217 bulge on the entire side surfaces 265 and 267 from the angular portions E in the square shape, the mold forms, the upper mold and the lower mold have an acute angle relationship.

However, in this embodiment, the bulge portions 269 partially bulge on the side surfaces 265 and 267, i.e., the flat portions 271 are formed on both sides of each bulge portion 269, and hence the mold forms, the upper mold and the lower mold come into contact with each other in a substantially perpendicular relationship. Therefore, it is possible to prevent a large compression reactive force from acting on end portions of the molds. Therefore, a sufficient compression force can be applied, thereby avoiding a damage to the molds in a short time.

Furthermore, the connection portion 275 between the upper surface 261 of the winding core portion 217 and the winding core portion side surface 213*a* or 215*a* of the flange portion 213 or 215 and the connection portion 277 between the winding core portion side surface 213*a* or 215*a* of the flange portion 213 or 215 and the upper surface 213*c* or 215*c* are subjected to R processing larger than naturally performed processing. As a result, it is possible to avoid generation of cracks on a boundary between the winding core portion 217 and the flange portion 213 or 215 or generation of fractures or chips in the flange portion 213 or 215. Occurrence of such cracks, fractures or chips is caused by the fact that the coil 205 is surrounded by the insulating sheath body 207 when the coil 205 expands, and another factor is that an expansion force acts on the coil 205 as a reactive force. Therefore, the mode in which the coil 205 is covered with the insulating sheath body 207 like the present invention is effective for prevention of cracks, fractures or chips in particular. Furthermore, the conformation in which the connection portion 275 between the upper surface 261 of the winding core portion 217 and the winding core portion side surface 213*a* or 215*a* of the flange portion 213 or 215 is subjected to taper machining can obtain the same effects as those of the R processing.

Although the contents of the present invention have been concretely described with reference to the preferred embodiments, it is self-evident that persons skilled in the art can accept various modifications based on basic technical concepts and teachings of the present invention.

For example, although the bulge portion 269 of the winding core portion 217 is constituted of the continuous curved line as seen in the lateral cross section in the foregoing embodiment, the present invention is not restricted thereto, and the bulge portion may be constituted of a discontinuous curved line or a partially straight line.

Moreover, the coil apparatus 201 according to the present invention can be used as the keyless entry system, the immobilizer and the air pressure monitoring system mentioned above as well as not only an in-vehicle antenna and an automobile component but also a general electronic component such as an antenna, transponder or an inductor.

Each structure described or suggested in <Second Embodiment of the Invention> can be combined with an arbitrary structure described or suggested in <First Embodiment of the Invention>. For example, for each through hole 243 or 244 provided in each terminal 209 or 211, it is possible to adopt an arbitrary structure, arrangement, shape or the like described or suggested in <First Embodiment of the Invention>. A concrete example is as follows.

Each second portion (the intermediate portion) 227 or 229 in each terminal 209 or 211 has a hole 243 or 244 in a plane thereof, and both inner edges of each hole 243 or 244 opposed to each other in at least one direction have an arc shape. The hole 243 or 244 is not restricted to a circular hole, and it may be an oval hole, an elliptic hole or the like.

Third Embodiment of the Invention

A third embodiment according to the present invention will now be described with reference to the accompanying drawings.

Figure 17:
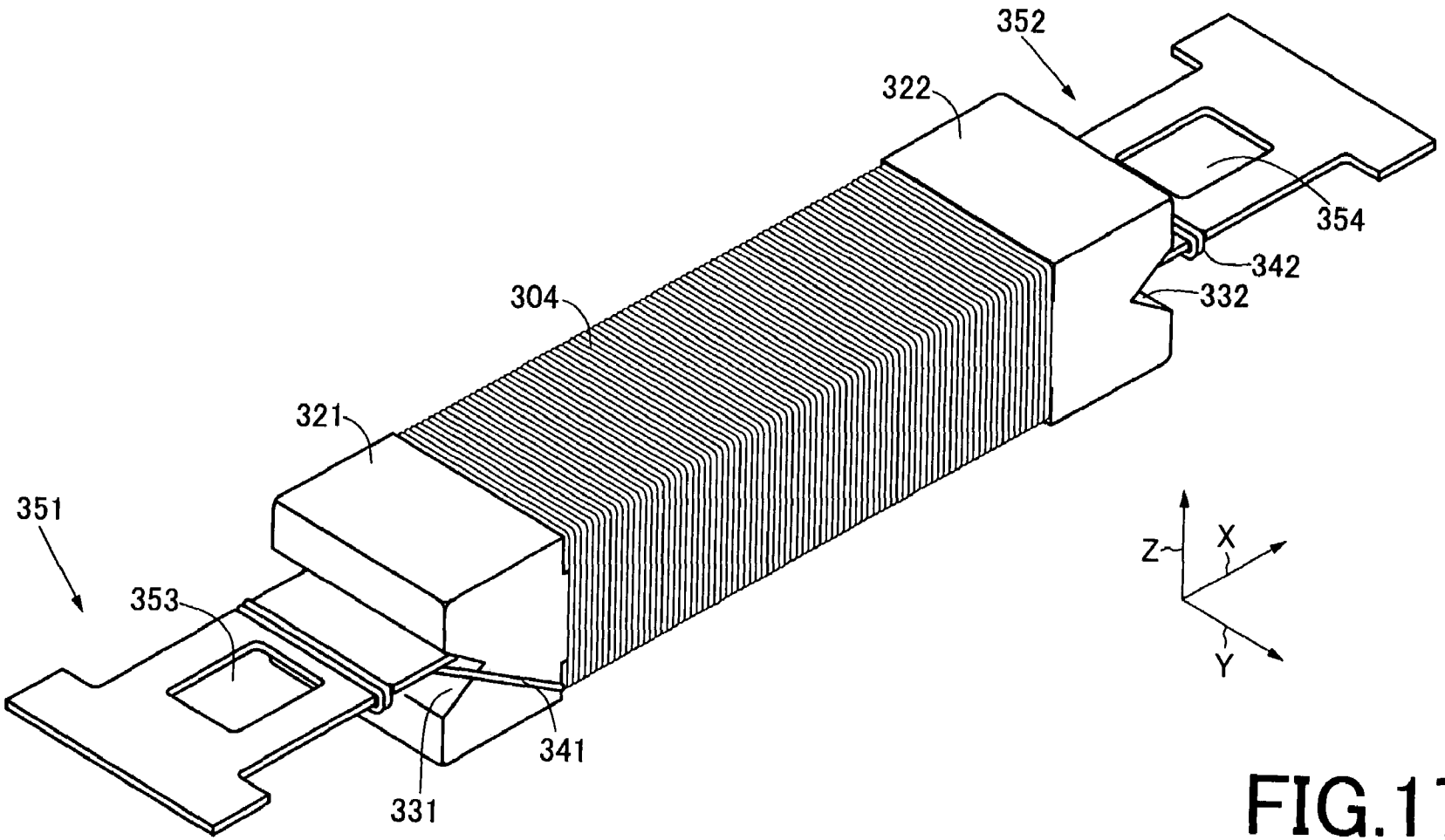
FIG. 17 is a perspective view showing a state before a terminal is bent in the coil apparatus depicted in FIG. 16.

FIG. 16 is a cross-sectional view of a coil apparatus according to a still further embodiment of the present invention. FIG. 17 is a perspective view showing a state before each terminal is bent in the coil apparatus depicted in FIG. 16. The coil apparatus of the illustrated embodiment can be used in an antenna, an in-vehicle antenna, a transponder, an inductor for an electronic device or the like. The illustrated coil apparatus includes a core 301, a coil 304, two terminals 351 and 352 and an insulating covering body 307.

The core 301 includes a coil winding portion 311 and two flange portions 321 and 322. The core 301 in the illustrated embodiment is formed of ferrite, and can be obtained from a sintered body of ferrite particles, by machining processing of a ferrite rod material or by combining the sintered body with machining processing.

The coil winding portion 311 extends in a longitudinal direction X. In the illustrated embodiment, the coil winding portion 311 has a square cross section. Besides, it is possible to accept an arbitrary cross-sectional shape such as any other polygonal cross section, a circular cross section or an elliptic cross section. The coil winding portion 311 has an elongated shape which is long in the longitudinal direction X.

The flange portions 321 and 322 are respectively consubstantially provided with the coil winding portion 311 at both ends of the coil winding portion 311 in the longitudinal direction X, and have grooves 331 and 332 on an outer end surfaces in the longitudinal direction X. Each flange portion 321 or 322 has a square cross section at a position where the groove 331 or 332 does not exist. It is preferable that an outer edge portion and an inner angular portion of the flange portion 321 or 322 are rounded or slightly chamfered.

Each of the grooves 331 and 332 has a depth direction matching with the longitudinal direction X, has a groove width in a thickness direction Z, extends in a width direction Y, and has a groove width Z3 which is narrowed toward a bottom portion. According to this configuration, it is possible to obtain a highly reliable core and a coil apparatus having excellent impact resistant properties and vibration resistant properties by selecting a depth of the groove 331 or 332 with respect to a dimension of the flange portion 321 or 322 in the longitudinal direction X.

Each groove 331 or 332 has a complete V shape in which both inclined surfaces cross each other at a bottom portion and a depth direction matches with the longitudinal direction X in the drawing. Besides, each groove may have a shape in which the bottom portion is a flat surface or a circular surface, for example. Further, although each groove is formed over a full width of the flange portion 321 or 322 in the drawing, it may be configured to be shorter than the full width and closed at both ends.

The coil 304 and the terminals 351 and 352 are combined with the core 301. The coil 304 is wound around the coil winding portion 311 of the core 301. The number of times of winding, a wire diameter and others of the coil 304 vary depending on a coil apparatus to be obtained.

Each of the terminals 351 and 352 is formed of a metal sheet material, has two bent portions (first and second bent portions) which are inwardly bent, has one end inserted and fixed in the groove 331 or 332 of the core 301, and has an end 41 or 42 of the coil 304 connected thereto. As the metal sheet material constituting each terminal 351 or 352, it is possible to use a non-magnetic material having spring properties, e.g., a phosphor bronze plate or a stainless-based metal sheet such as SUS 304-CSP.

One end of each terminal 351 or 352 is inserted into the groove 331 or 332 of the core 301. Since the groove width of each groove 331 or 332 is narrowed toward the bottom portion as described above, each terminal 351 or 352 is positioned in the groove 331 or 332 at a fixed position determined by a board thickness. Therefore, a position of the terminal 351 or 352 with respect to the core 301 is uniquely determined, thereby producing no fluctuation in frequency-inductance characteristics and in frequency-Q characteristics involved by a change in position of each terminal 351 or 352.

Each groove 331 or 332 of each flange portion 321 or 322 has both inclined surfaces crossing each other at the bottom portion, has a depth direction matching with the longitudinal direction X, has a groove width in a thickness direction Z, and extends in a width direction Y. Therefore, each terminal 351 or 352 is fixed in the groove 331 or 332 in such a manner that a board surface becomes parallel with the flange portion 321 or 322 of the core 301 as seen from the thickness direction Z.

The terminal 351 or 352 is fixed in the groove 331 or 332 by each adhesive 61 or 62 filled in the groove 331 or 332. In the illustrated embodiment, the terminal 351 or 352 has a notch at one end which is inserted into the groove 331 or 332. With such a configuration, since the adhesive 61 or 62 is filled in the notch, attachment strength of each terminal 351 or 352 with respect to the core 301 is improved.

The insulating covering body 307 covers the core 301, the coil 304 and a part of each terminal 351 or 352. According to this configuration, the insulating covering body 307 protects the core 301 and the coil 304, and improves coupling strength of the terminals 351 and 352 with respect to the core 301, thereby realizing the coil apparatus having excellent mechanical reliability.

The core 301 and the coil 304 are positioned at a substantially central part of the insulating covering body 307. That is, in FIG. 16, thicknesses t1 and t2 of the insulating covering body 307 which covers an upper surface and a lower surface of the core 301 are substantially equal to each other. Although not shown, on both side surfaces which are continuous with the upper surface and the lower surface as seen from a cross section vertical to the upper surface and the lower surface, thicknesses of the insulating covering body 307 are substantially equal to the thicknesses t1 and t2 of covering on the upper surface and the lower surface. According to this configuration, the core 301 and the coil 304 are sealed in the insulating covering body 307 so that the core 301 and the coil 304 can be prevented from being entirely or partially exposed, thereby realizing the highly reliable coil apparatus having excellent impact resistant properties and vibration resistant properties.

Further, since the core 301 and the coil 304 are positioned at the substantially central part of the insulating covering body 307, the thicknesses t1 and t2 of the insulating covering body 307 can be set to necessary minimum values. Therefore, outside dimensions of the core 301 and the coil 304 provided inside can be relatively set large with respect to a determined outside dimension of the coil apparatus, thus obtaining excellent electrical characteristics.

Figure 18:
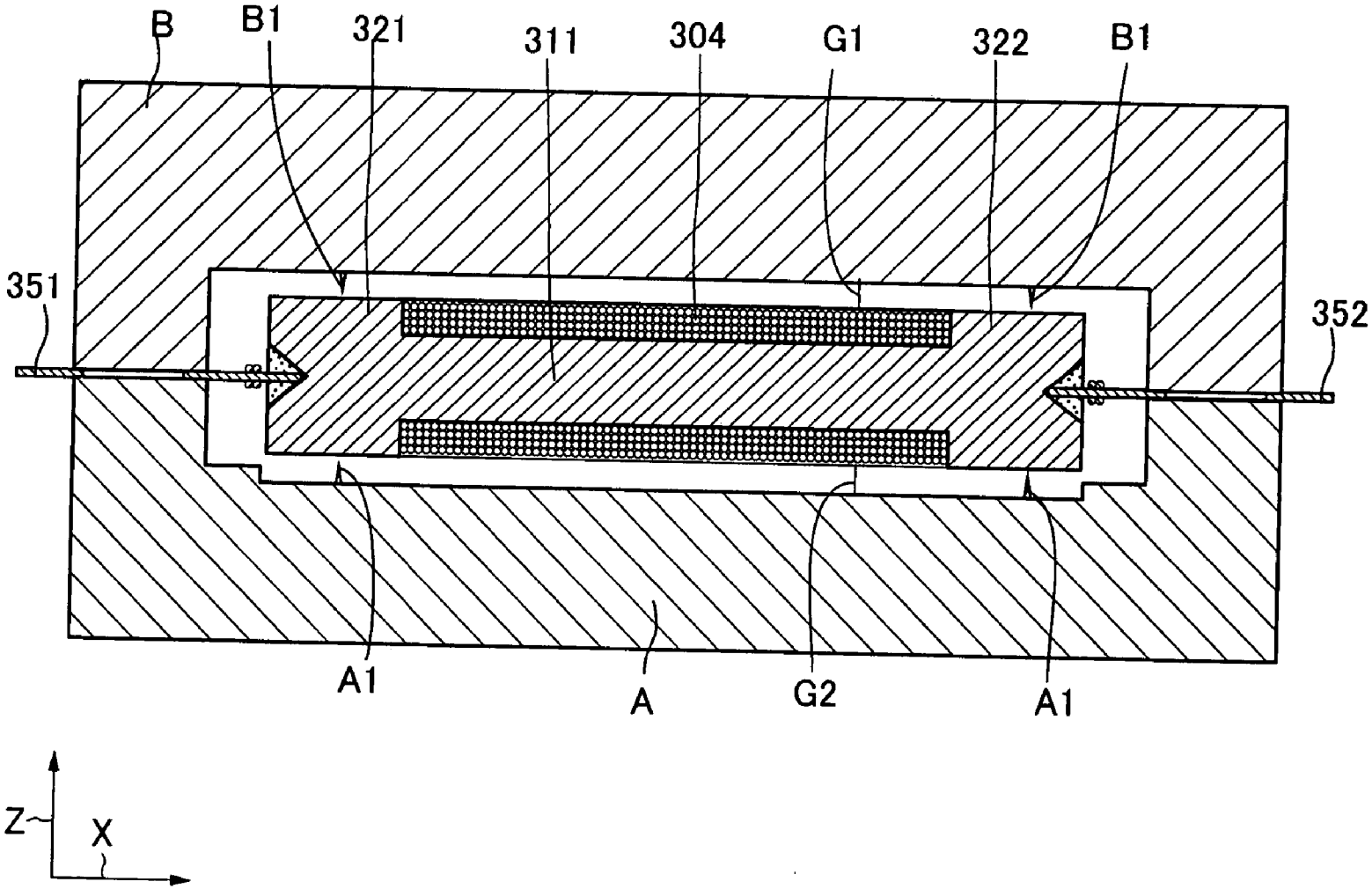
FIG. 18 is a view showing a molding step of an insulating covering body formed of a thermoplastic resin.

FIG. 18 is a view showing a molding step suitable for positioning the core 301 and the coil 304 at the substantially central part of the insulating covering body 307. In the example of FIG. 18, protrusions A1 and B1 having substantially the same height are provided in a cavity of a lower mold A and an upper mold B, and the core 301 and the coil 304 are accurately positioned at predetermined positions in the lower mold A and the upper mold B by using the protrusions A1 and B1. It is preferable for each of the protrusions A1 and B1 to have an end which is slightly apart from the surface of the core 301. As a result, the core 301 and the coil 304 are positioned at the substantially central part of the insulating covering body and completely covered with the insulating covering body 307 without being exposed to the outside from the insulating covering body 307.

Furthermore, according to the molding step, since positional restriction of the core 301 and the coil 304 by the protrusions A1 and B1 can maintain gaps G1 and G2 between the lower and upper molds A and B and the core 301 and the coil 304 constant, the thicknesses t1 and t2 (see FIG. 16) of the insulating covering body 307 can be set to the necessary minimum values. Therefore, the outside dimensions of the core 301 and the coil 304 provided inside can be relatively set large with respect to the determined outside dimension of the coil apparatus, thus obtaining excellent electrical characteristics.

The insulating covering body 307 is formed of a thermoplastic insulating resin. When the insulating covering body 307 is constituted of a thermoplastic insulating resin, an influence of thermal expansion and contraction of the insulating covering body on the core 301 can be reduced as compared with a case where the insulating covering body is formed of a thermosetting insulating resin. Therefore, a thermal stress in the core 301 is reduced, thereby decreasing a variation in an inductance value due to a fluctuation in a temperature.

Figure 19:
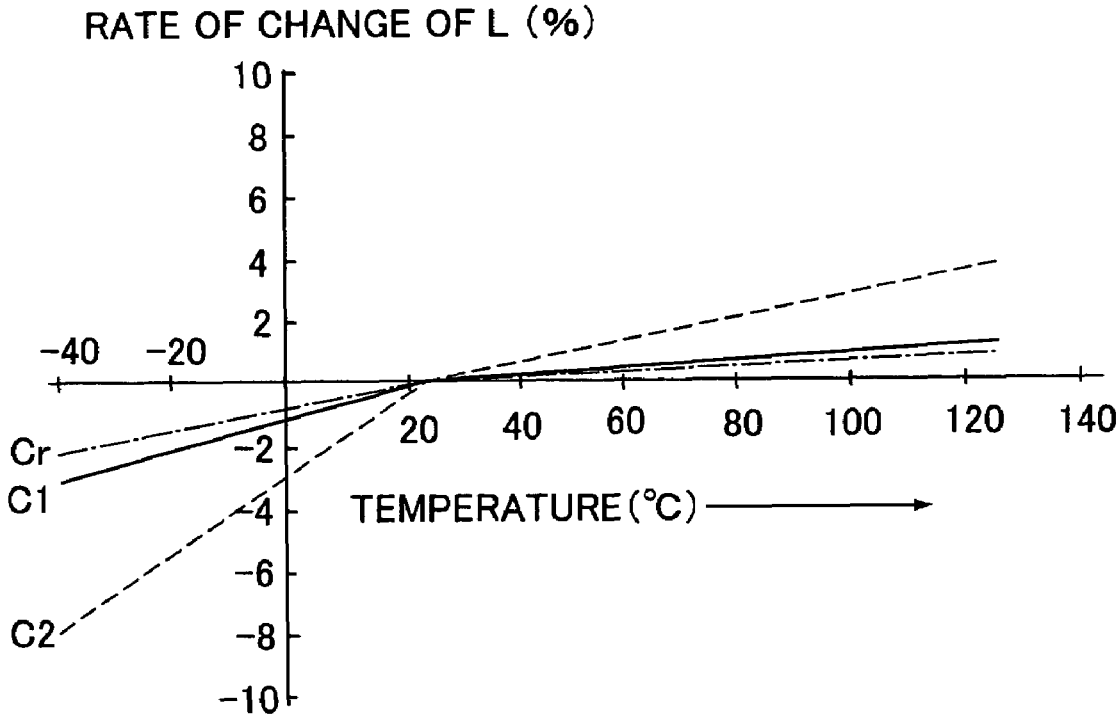
FIG. 19 is a view showing a temperature-L rate-of-change characteristic data.

FIG. 19 is a view showing temperature-L rate-of-change characteristic data. In the drawing, a horizontal axis represents a temperature (° C.), and a vertical axis represents a rate of change of L(%) which is a rate of change of an inductance. A curve Cr indicates characteristics when the insulating covering body 307 is not provided, a curve C1 indicates characteristics of the coil apparatus according to the present invention using a thermoplastic resin (a liquid crystal polymer), and a curve C2 indicates characteristics of the coil apparatus using a thermosetting resin (a diallyl resin) as the insulating covering body 307. The characteristic curves Cr, C1 and C2 are all obtained by the coil apparatus having the configuration shown in FIGS. 22 and 23 except the insulating covering body 307.

Referring to FIG. 19, when a thermosetting resin is used as the insulating covering body 307, as indicated by the characteristic curve C2, the temperature-L rate-of-change characteristics are greatly disjunct from the characteristic curve Cr which is a reference. On the contrary, the coil apparatus according to the present invention demonstrates the temperature-L rate-of-change characteristics which are very close the reference characteristic curve Cr. It can be considered that, when the insulating covering body 307 is formed of a thermoplastic insulating resin, an influence of thermal expansion and contraction on the core 301 is decreased, a stress of the core 301 can be reduced, and magnetic characteristics (the characteristic curve Cr) inherent to the core 301 can be demonstrated as compared with the case where the insulating covering body 307 is formed of a thermosetting resin (the characteristic curve C2).

Each structure described or suggested in <Third Embodiment of the Invention> can be combined with an arbitrary structure described or suggested in <First Embodiment of the Invention>. For example, for each through hole 353 or 354 provided in each terminal 351 or 352, it is possible to adopt an arbitrary structure, arrangement, shape or the like described or suggested in <First Embodiment of the Invention>. A concrete example is as follows.

An intermediate portion (a part between the two bent portions) of each terminal 351 or 352 has a hole 353 or 354 in a plane thereof, and both inner edges of each hole 353 or 354 opposed to each other in at least one direction have an arc shape. The hole 353 or 354 is not restricted to a circular hole, and it may be an oval hole, an elliptic hole or the like.

Fourth Embodiment of the Invention

A fourth embodiment according to the present invention will now be described hereinafter with reference to the accompanying drawings.

Figure 20:
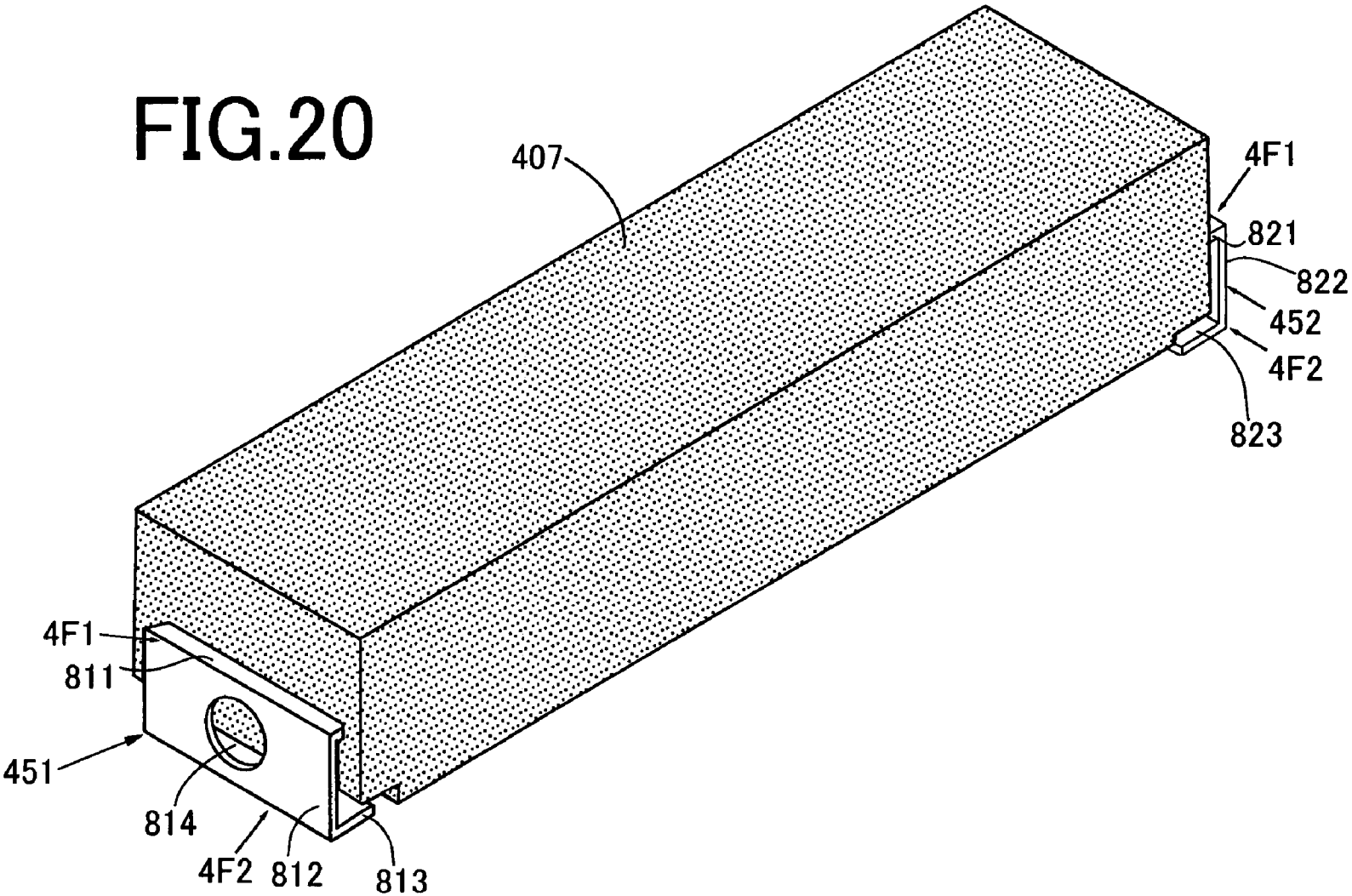
FIG. 20 is an appearance perspective view of a coil apparatus according to a yet further embodiment of the present invention.
Figure 22:
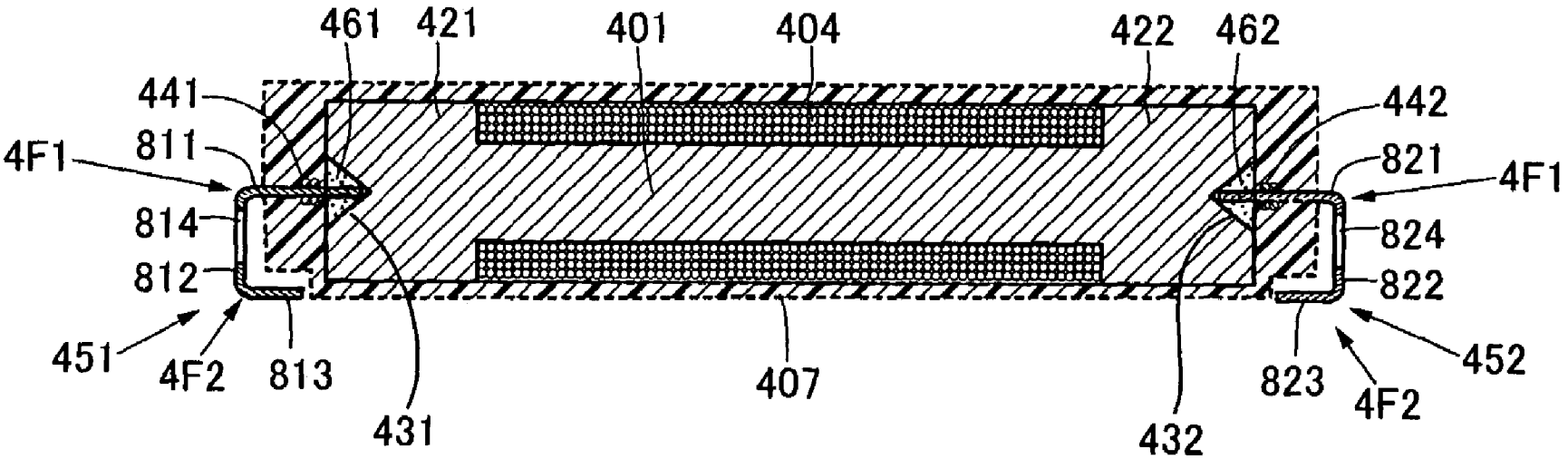
FIG. 22 is a front cross-sectional view of the coil apparatus depicted in FIGS. 20 and 21.

FIG. 20 is an appearance perspective view of a coil apparatus according to a yet further embodiment of the present invention, FIG. 21 is a perspective view in which an insulating resin sheath body is eliminated in order to show an internal structure of the coil apparatus depicted in FIG. 20, and FIG. 22 is a front cross-sectional view of the coil apparatus depicted in FIGS. 20 and 21. This coil apparatus can be used for an antenna, an in-vehicle antenna, a transponder, a choke coil, an inductor for an electronic device and others.

Referring to FIGS. 20 to 21, the coil apparatus includes a core 410, a winding 404, terminals 451 and 452, and an insulating resin sheath body 407.

The core 410 has terminal attachment portions 421 and 422 at opposing both ends thereof, and a winding portion 401 in an intermediate portion thereof. The core 410 is typically a ferrite core, and its material is selected in accordance with requested characteristics. The ferrite core can be obtained from a sintered body of ferrite particles, by mechanical processing of a ferrite rod material, or by combining the sintered body with mechanical processing.

The winding portion 401 has an elongated shape which extends in a longitudinal direction X. In the illustrated embodiment, the winding portion 401 has a square cross section. Besides, it is possible to accept an arbitrary cross-sectional shape such as any other polygonal cross section, a circular cross section, an elliptic cross section and others.

The respective terminal attachment portions 421 and 422 are provided at both ends of the winding portion 401 in the longitudinal direction consubstantially with the winding portion 401, and have concave portions 431 and 432 on outer end surfaces in the longitudinal direction X. Each of the illustrated terminal attachment portions 421 and 422 has a flange-like shape, and its cross section at a position where the concave portion 431 or 432 does not exist is a square cross section. It is preferable that an outer edge portion and an inner angular portion of each terminal attachment portion 421 or 422 are rounded or slightly chamfered.

Each of the concave portions 431 and 432 has a depth direction matching with the longitudinal direction X, extends in a width direction Y, and has a width which is narrowed toward a bottom portion. Each concave portion 431 or 432 has a substantially complete V shape in which both inclined surfaces cross each other at the bottom portion and the depth direction matches with the longitudinal direction X in the drawing. Besides, it is possible to accept a shape in which the bottom portion is a flat surface or a circular surface. Additionally, each concave portion 431 or 431 is formed over a full width of each terminal attachment portion 421 or 422 in the drawing, it may be configured to be shorter than the full width and closed at both ends.

The winding 404 is wound around the winding portion 401 of the core 410. The number of times of winding, a wire diameter and others of the winding 404 vary depending on a coil apparatus to be obtained.

Each of the terminals 451 and 452 is formed of one bent metal sheet. As the metal sheet material constituting each terminal 451 or 452, a non-magnetic material having spring properties, e.g., a phosphor bronze plate or a stainless-based metal sheet such as SUS 304-CSP is suitable.

Each of the terminals 451 and 452 has a first bent portion 4F1 and a second bent portion 4F2. The first bent portion 4F1 forms an attachment portion 811 or 821 which is bent in a direction facing the outer end surface with a gap therebetween from the attachment portion 811 or 821 which is led in a direction apart from the core 410 along the longitudinal direction X. The first bent portion 4F1 and the second bent portion 4F2 are provided outside the insulating resin sheath body 407.

The second bent portion 4F2 forms a bottom portion 813 or 823 which is bent in a direction closer to the core 410 along the longitudinal direction X from the attachment portion 811 or 821. An end of the bottom portion 813 or 823, i.e., a free end is positioned outside the outer end surface of the core 410 as seen from the longitudinal direction X. According to this arrangement, frequency-inductance characteristics and frequency-Q characteristics can be improved.

One end of each attachment portion 811 or 821 is fixed to each terminal attachment portion 421 or 422 of the core 410. Specifically, it is positioned in each concave portion 431 or 432 at a fixed position determined by a board thickness. Therefore, a position of each terminal 451 or 452 with respect to the core 410 is uniquely determined, thereby producing no fluctuation in frequency-inductance characteristics and in frequency-Q characteristics involved by a change in position of each terminal 451 or 452.

Each attachment portion 811 or 812 is fixed in each concave portion 431 or 432 by each adhesive 61 or 62 filled in the concave portion 431 or 432. In this case, when a notch or the like is provided at one end inserted into the concave portion 431 or 432, since the adhesive 61 or 62 is filled in the notch, attachment strength of each terminal 451 or 452 with respect to the core 410 can be improved. Each winding end 41 or 42 is wound around each attachment portion 811 or 821 for two or three times and preferably joined by using a Pb free solder.

The insulating resin sheath body 407 covers all of the core 410 and the winding 404. Further, at least a part of a surface of the insulating resin sheath body 407 is roughened. The insulating resin sheath body 407 can be formed of an epoxy resin or the like.

Figure 23:
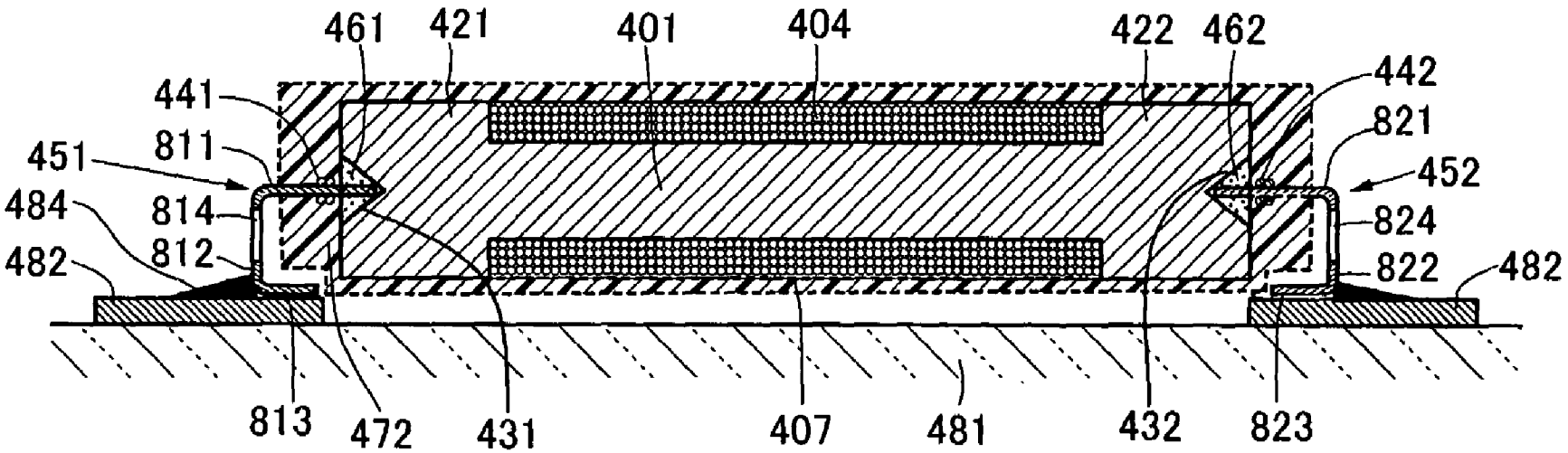
FIG. 23 is a view showing a use state of the coil apparatus depicted in FIGS. 20 to 22.

FIG. 23 is a cross-sectional view showing a use state of the coil apparatus depicted in FIGS. 20 to 22. As shown in the drawings, in a state where the coil apparatus is used, it is utilized with the bottom portions 813 and 823 being soldered 484 on each conductor pattern 482 provided on a circuit substrate 81. The coil apparatus is attached in such a manner that a gap is produced between a lower surface of the insulating sheath body 407 and a surface of the circuit substrate 481.

Here, since the insulating resin sheath body 407 covers all of the core 410 and the winding 404, all of the core 410 having physical weakness and the winding 404 can be protected by the insulating resin sheath body 407, thereby realizing the coil apparatus having excellent impact resistant properties and vibration resistant properties.

Furthermore, since each terminal 451 or 452 to which an end of the winding 404 is connected is formed of one metal sheet, and one end of each terminal 451 or 452 is fixed to each terminal attachment portion 811 or 821 of the core 410. Moreover, the first bend portion 4F1 and the second bent portion 4F2 are provided between one end and the other end, and the first bent portion 4F1 and the second bent portion 4F2 are provided outside the insulating resin sheath body 407.

According to this configuration, as shown in FIG. 23, when the coil apparatus is mounted on the substrate 481, spring properties produced by the first bent portion 4F1 and the second bent portion 4F2 can be assured, and impact shocks and vibrations can be absorbed. Therefore, it is possible to realize the coil apparatus having excellent impact resistant properties and vibration resistant properties.

As described above, since the insulating resin sheath body 407 covers all of the core 410 and the winding 404, impact resistant properties and vibration resistant properties can be improved, whereas the insulating resin sheath body 407 obstructs radiation of heat generated in the winding 404. Since an electric resistance value of the winding 404 has temperature dependency, characteristics vary unless heat radiation is facilitated. A change in characteristics by a temperature is also observed in the core 410.

Thus, as means for solving this problem, in this embodiment, at least a part of the surface of the insulating resin sheath body 407 is roughened. A typical example of roughening is so-called "texturing".

As described above, when the surface of the insulating resin sheath body 407 is roughened, a surface area of the insulating resin sheath body 407 is increased in accordance with a roughened surface area, properties of roughening and others. Therefore, a heat radiation area is substantially increased to facilitate heat radiation, thereby improving thermal stability of characteristics.

Although it is ideal to roughen the entire surface of the insulating resin sheath body 407, roughening may be partially performed. As a technique of roughening, it is possible to accept a method by which a surface (an inner surface) of a mold which is used for formation of the insulating resin sheath body 407 is roughened to 3 to 9 μm by texturing electric discharge machining and an obtained rough pattern is transferred onto the surface of the insulating resin sheath body 407, a method by which the surface of the already formed insulating resin sheath body 407 is roughened by sandblasting, chemical processing or the like, and others.

Additionally, in this embodiment, since each terminal 451 or 452 has the first bent portion 4F1 and the second bent portion 4F2, impact shocks and vibrations can be absorbed by spring properties generated by the first bent portion 4F1 and the second bent portion 4F2. Therefore, it is possible to realize the coil apparatus having excellent impact resistant properties and vibration properties.

Further, in this embodiment, each intermediate portion 812 or 822 has each hole 814 or 824 in a plane thereof. In each of the holes 814 and 824, both inner edges opposing in at least one direction have an arc shape. This point will now be described.

Each of the intermediate portion 812 and 822 is a part which faces each end surface of the core 410, and has a relationship in which a board surface thereof is orthogonal to or crosses a magnetic flux caused by a current flowing through the winding 404. Therefore, each intermediate portion serves as an obstacle part which obstructs a smooth flow of the magnetic flux, thereby possibly deteriorating frequency-inductance characteristics and frequency-Q characteristics. Thus, in this embodiment, each hole 814 or 824 is formed in the plane of each intermediate portion 812 or 822.

Since existence of each hole 814 or 824 mentioned above provides a structure in which a cross-sectional area of each intermediate portion 812 or 822 is smaller than a cross-sectional area of each attachment portion 811 or 821 and that of each bottom portion 813 or 823, an obstacle with respect to the flow of the magnetic flux becomes small, thus suppressing deterioration in frequency-inductance characteristics and frequency-Q characteristics.

As described above, provision of each hole 814 or 824 to each intermediate portion 812 or 822 lowers mechanical strength of each intermediate portion 812 or 822. A reduction in mechanical strength must be suppressed as much as possible. Or else, it is hard to assure impact resistant properties and vibration resistant properties required in an application in a severe use environment, e.g., an in-vehicle coil apparatus.

As means for solving such a problem, in this embodiment, each hole 814 or 824 has a shape in which both inner edges opposing in at least one direction have an arc shape. Each hole 814 or 824 is not restricted to a circular hole, and it may be an oval hole, an elliptic hole or the like.

According to the above-described hole shape, as different from, e.g., a square hole having acute inner angles, it is possible to assure sufficient mechanical strength and satisfactorily meet impact resistant properties and vibration resistant properties required in an application in a severe use environment, e.g., an in-vehicle coil apparatus. It seems simple technical processing which changes a square hole to a circular hole, but it is effective means which demonstrates maximum effects in a restricted structure.

Further, it is preferable to arrange each hole 814 or 824 at such a position as a distance Z11 from the second first bent portion 4F1 and the second bent portion 4F2 to a hole edge becomes larger than a distance Z12 from the first bent portion 4F1 and the second bent portion 4F2 to the hole edge, i.e., arrange each hole 814 or 824 to be biased in a direction of each attachment portion 811 or 821 as viewing the direction of height Z.

Figure 24:
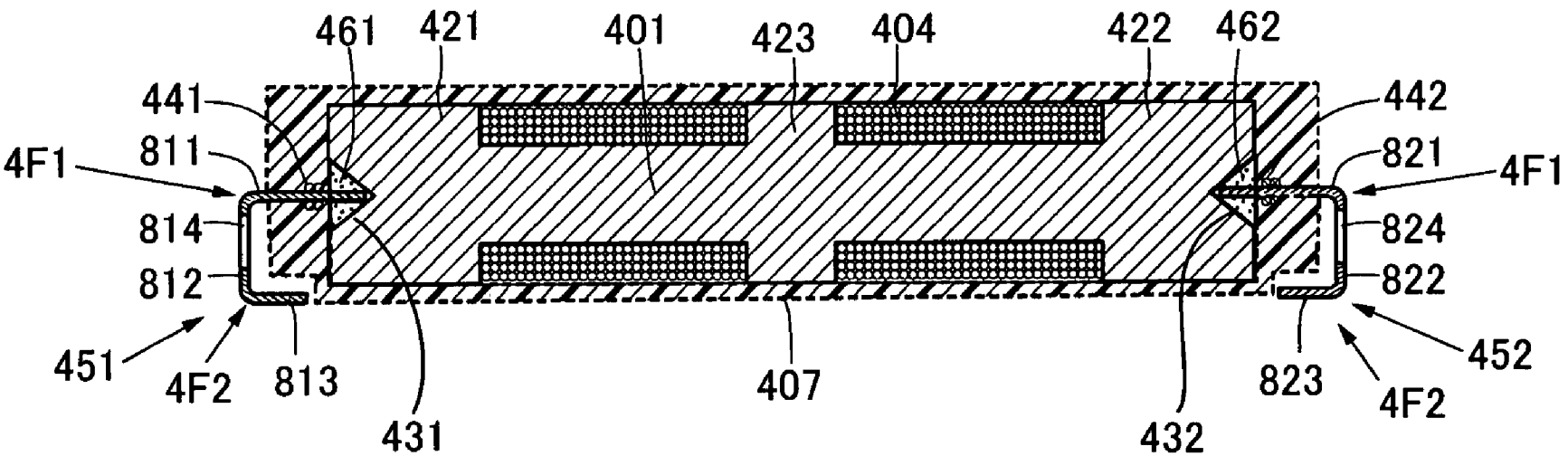
FIG. 24 is a cross-sectional view of a coil apparatus according to another embodiment of the present invention.

FIG. 24 is a cross-sectional view of a coil apparatus according to another embodiment of the present invention. In the drawing, like reference numerals denote parts corresponding to the constituent parts shown in FIGS. 20 to 22, thereby eliminating the tautological explanation. In this embodiment, a core 410 has a partition portion 423 in an intermediate portion thereof, and has winding 404 wound around both sides of the partition portion. That is, a winding portion 401 is divided into a plurality of parts. The winding 404 is continuously wound in the same direction in the plurality of divided winding portions 401. A substantially entire surface of an insulating resin sheath body 407 is roughened. This embodiment demonstrates functions and effects equivalent to those of the embodiment shown in FIGS. 20 to 23.

Each structure described or suggested in <Fourth Embodiment of the Invention> can be combined with an arbitrary structure described or suggested in <First Embodiment of the Invention>. For example, for each hole 814 or 824 provided in each terminal 451 or 452, it is possible to adopt an arbitrary structure, arrangement, shape or the like described or suggested in <First Embodiment of the Invention>. A concrete example is as follows.

Each intermediate portion 812 or 822 in each terminal 451 or 452 has a hole 814 or 824 in a plane thereof, and both inner edges of the hole 814 or 824 opposed to each other in at least one direction have an arc shape. The hole 814 or 824 is not restricted to a circular hole, and it may be an oval hole, an elliptic hole or the like.

Fifth Embodiment of the Invention

A fifth embodiment of the present invention will now be described hereinafter with reference to the accompanying drawings. It is to be noted that like reference numerals denote the same or corresponding parts in the drawings.

Figure 25:
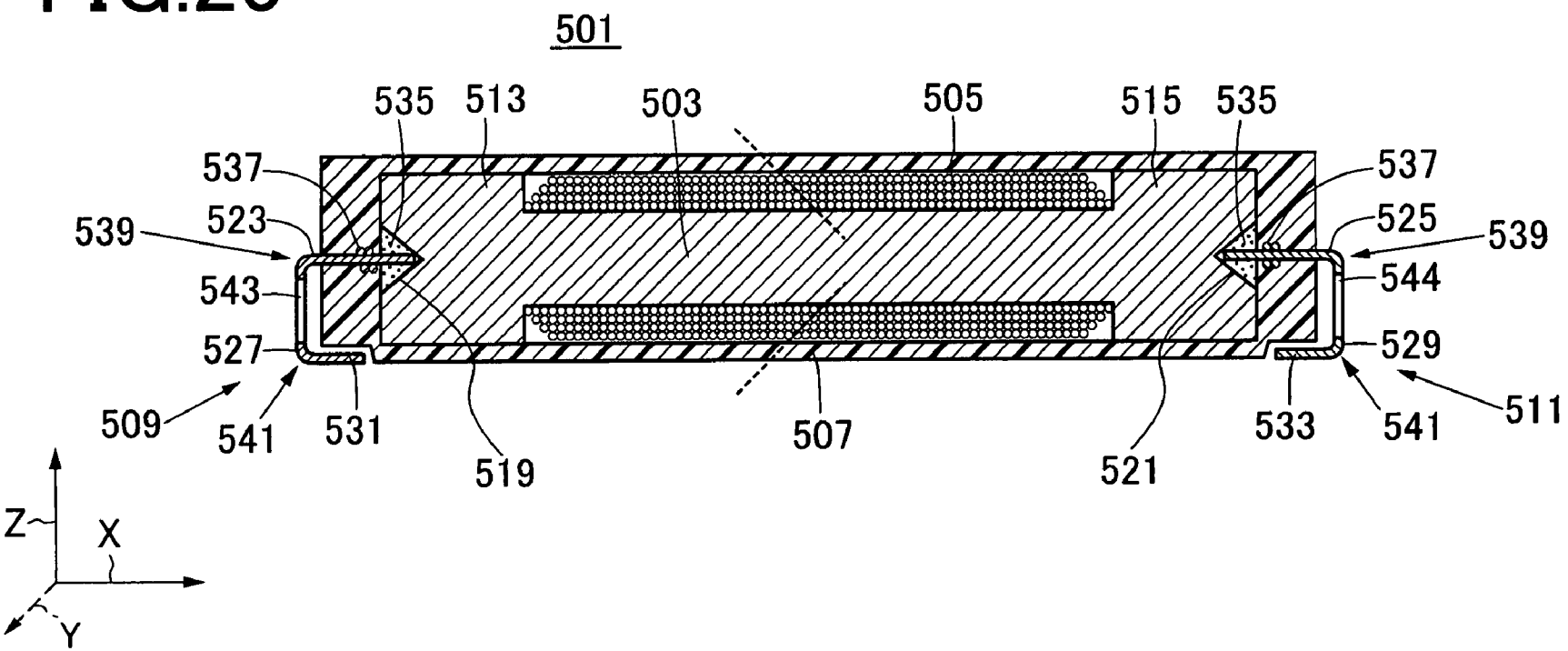
FIG. 25 is a vertical cross-sectional view of a coil apparatus according to another embodiment of the present invention.

FIG. 25 shows a vertical cross-sectional view of a coil apparatus according to this embodiment. A coil apparatus 501 mainly comprises a ferrite core 503, a coil 505, an insulating sheath body 507, and a pair of terminals 509 and 511. Further, the coil apparatus 501 is applied to a bi-directional keyless entry system which requires no operation of buttons, an anti-theft immobilizer, a tire air pressure monitoring system or the like in, e.g., an automobile.

The coil 505 is formed of a winding which is wound around an outer peripheral surface of the ferrite core 503 with the ferrite core 503 at the center. The insulating sheath body 507 is provided to cover the entire surfaces of the ferrite core 503 and the coil 505.

Figure 26:
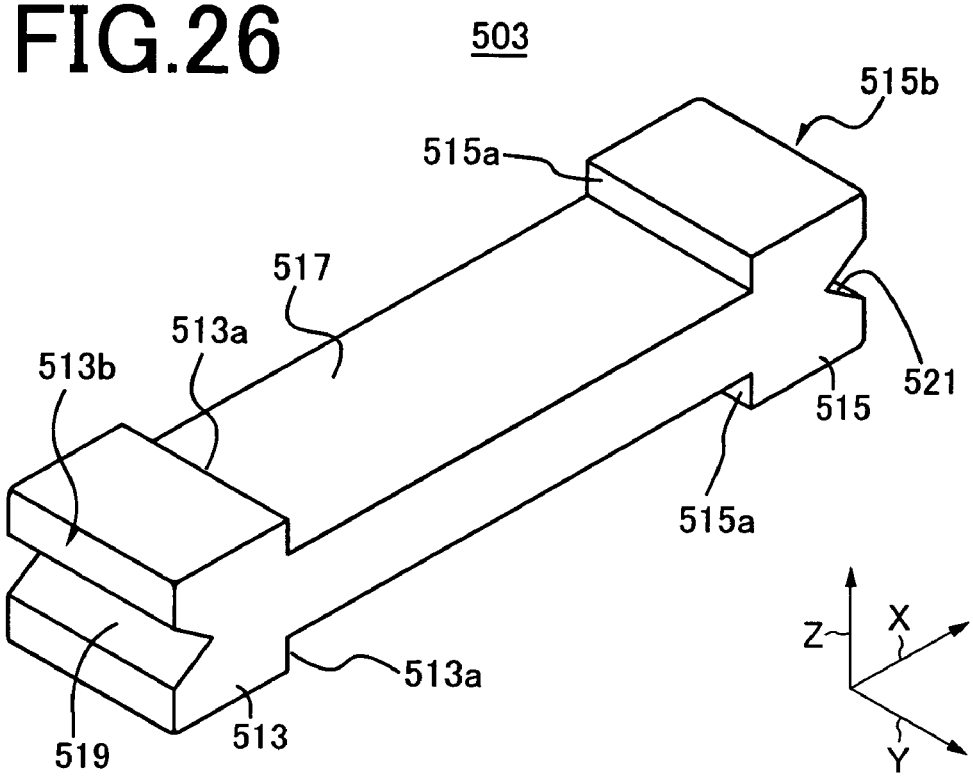
FIG. 26 is a perspective view of a ferrite core in the coil apparatus.
Figure 27:
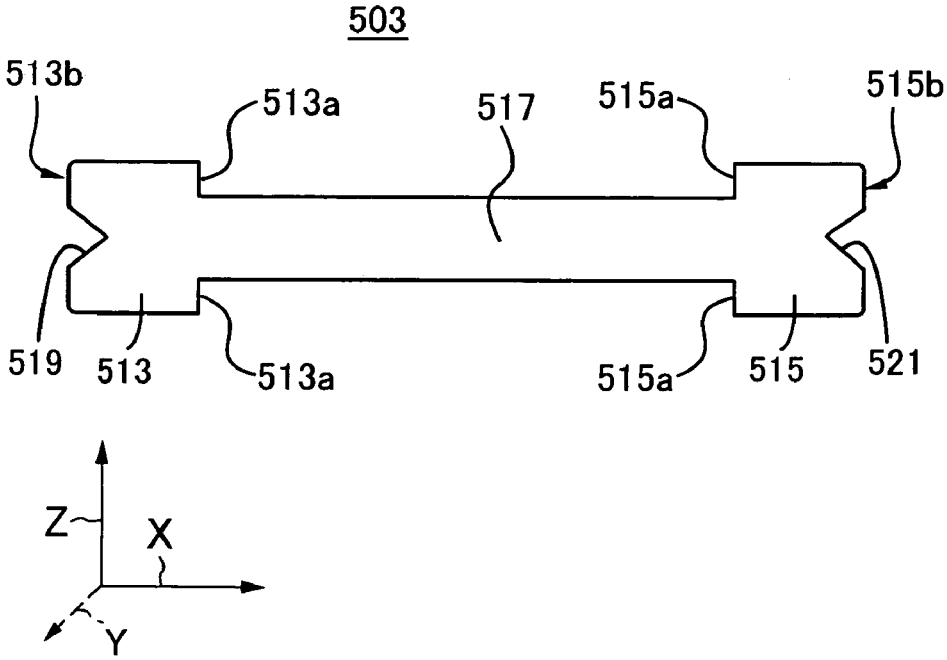
FIG. 27 is a side view of the ferrite core in the coil apparatus.

The ferrite core 503 can be obtained from a sintered body of ferrite particles, or by machining a ferrite rod material, or by combining the sintered body and machining. As shown in FIGS. 26 and 27, the ferrite core 503 is substantially a rod-like member, has flange portions 513 and 515 at both end portions in a longitudinal direction (an X direction) thereof, and has a winding core portion 517 between these flange portions 513 and 515.

The pair of flange portions 513 and 515 and the winding core portion 517 have a rectangular cross section in which a dimension in a Y direction is larger than a dimension in a Z direction. Furthermore, the pair of flange portion 513 and 515 and the winding core portion 517 are formed to have the same width dimension (a Y-direction dimension) along a core longitudinal direction.

In regard to a thickness dimension (a Z-direction dimension), the pair of flange portions 513 and 515 are formed to be thicker than the winding core portion 517. As a result, surfaces 513*a* and 515*a* of the pair of flange portions 513 and 515 which face a central side in the longitudinal direction respectively exist to substantially vertically rise from vertical surfaces of the winding core portions 517.

A pair of V-shaped grooves 519 and 521 are formed on surfaces 513*b* and 515*b* opposite to the surfaces 513*a* and 515*a* of the pair of flange portions 513 and 515. The pair of grooves 519 and 521 extend along the Y direction, and are opened on both end surfaces of the ferrite core 503 in the Y direction.

The pair of corresponding terminals 509 and 511 are engaged with the pair of grooves 519 and 521 as described above. Again referring to FIG. 1, each of the pair of terminals 509 and 511 is a metallic tabular member which is bent in a substantially U shape as seen from a ZX vertical cross section. More particularly, it is possible to use a non-magnetic material having spring properties, e.g., a phosphor bronze plate or a stainless-based metal sheet such as SUS 304-CSP.

Each of the pair of terminals 509 and 511 has three planar portions formed by bending a tabular member at two positions. Of the three planar portions, a first portion (an attachment portion) 523 or 525 and a third portion (a bottom portion) 531 or 533 extend along an XY plane, and a second portion (an intermediate portion) 527 or 529 extends along an YZ plane. The first portions 523 and 525 pierce the insulating sheath body 507. One end of the first portion 523 or 525 is inserted into each of the pair of corresponding grooves 519 and 521, and fixed by an adhesive 535. Moreover, a winding end 537 of the coil 505 is joined to each of the first portions 523 and 525 by soldering. The other end of each of the first portions 523 and 525 is connected with a first curved portion (a first bent portion) 539.

Each of the second portions 527 and 529 extends between the first curved portion 539 and a second curved portion (a second bent portion) 541. Additionally, a through hole 543 which is used to reduce a cross-sectional area of each of the second portions 527 and 529 to be smaller than that of each of the first portions 523 and 525 and each of the third portions 531 and 533 is formed in each of the second portions 527 and 529. Each of the third portions 531 and 533 extends from the second curved portion 541 toward the center in the core longitudinal direction in parallel with a lower surface of the insulating sheath body 507.

The insulating sheath body 507 is a substantially rectangular solid member which covers the ferrite core 503 and the coil 505. This insulating sheath body 507 protects the ferrite core 503 and the coil 505 and improves joint strength of the pair of terminals 509 and 511 with respect to the ferrite core 503, thereby realizing the structure with excellent mechanical reliability.

Figure 28:
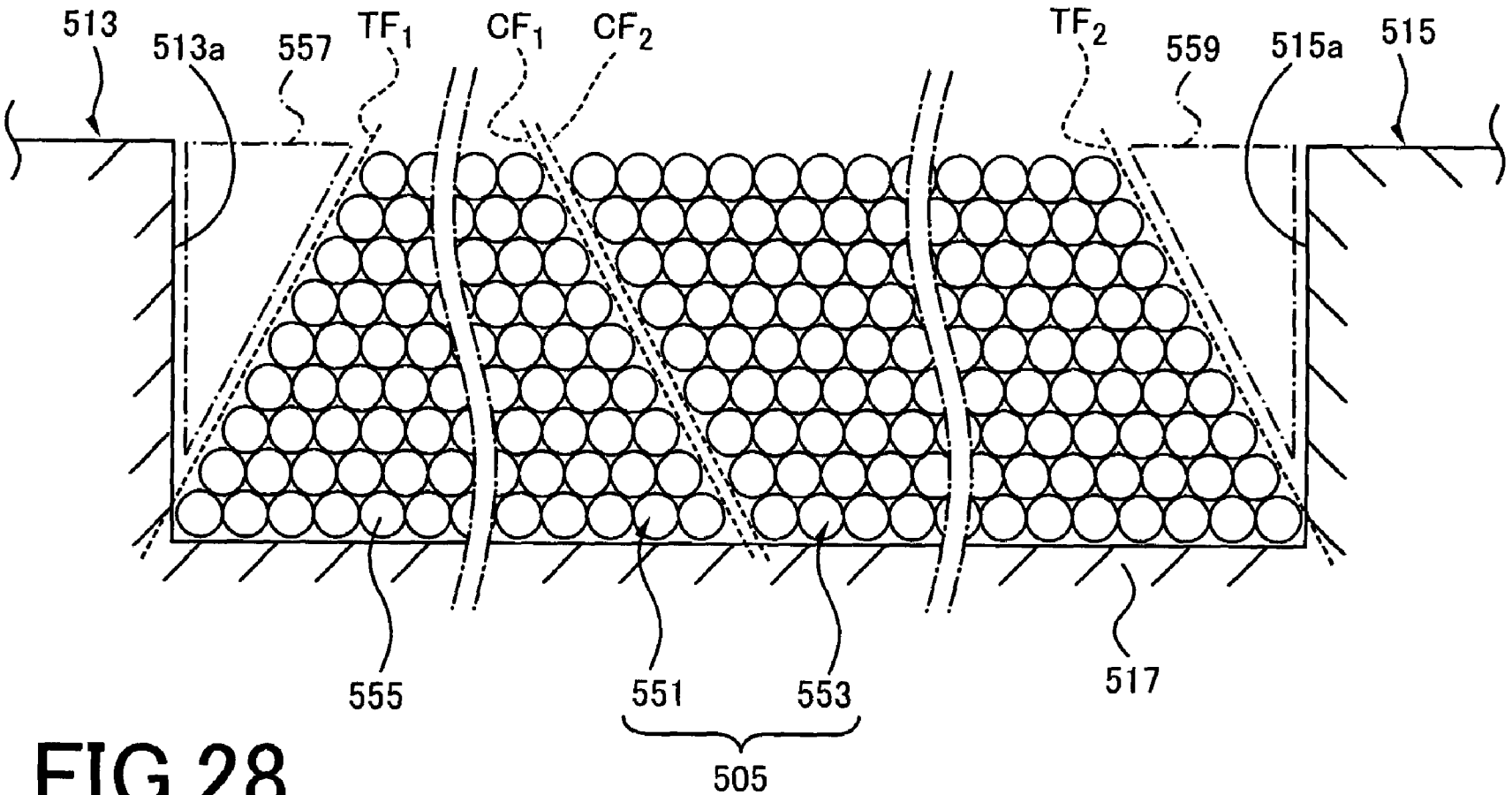
FIG. 28 is a view showing a configuration of a coil in the coil apparatus.

Particulars of the coil 505 will now be described with reference to FIG. 28. The coil 505 is arranged on an outer peripheral surface of the winding core portion 517 of the ferrite core 503 between the pair of surfaces 513*a* and 515*a*. Further, the coil 505 has a first coil portion 551 and a second coil portion 553 in this embodiment. Each of the first coil portion 551 and the second coil portion 553 is formed by winding and stacking a winding 555 around the ferrite core 503 in a predetermined range in the core longitudinal direction.

Furthermore, as the winding 555, a urethane wire is used in this embodiment. The urethane wire is a wire which does not have a cement coat like a so-called cement coated type wire. A boundary end surface $CF_1$ of the first coil portion 551 on the second coil portion 553 side does not extend in a direction orthogonal to an axial center direction or an outer peripheral surface of the ferrite core 503, but it is inclined in such a manner that an inner peripheral side of the boundary end surface is closer to the second coil portion 553 than an outer peripheral side of the same. Moreover, a boundary end surface $CF_2$ of the second coil portion 553 on the first coil portion 551 side also extends along the boundary end surface $CF_1$, namely, it is inclined.

Additionally, an end surface $TF_1$ of the first coil portion 551 opposite to the second coil portion 553 likewise does not extend in the direction orthogonal to the axial center direction or the outer peripheral surface of the ferrite core 503, but it is inclined in such a manner that an outer peripheral side of the end surface is farther from the flange portion 513 than an inner peripheral side of the same. Likewise, an end surface $TF_2$ of the second coil portion 553 opposite to the first coil portion 551 is inclined like the end surface $TF_1$ in such a manner that an outer peripheral side of the end surface is farther from the flange portion 515 than an inner peripheral side of the same. In this manner, in the first coil portion 551 and the second coil portion 553, since the end surfaces $TF_1$ and $TF_2$ on the pair of flange portions 513 and 515 side are inclined, extra spaces 557 and 559 each having a substantially inverted triangular shape as seen from a vertical cross section are formed between both ends of the coil 505 and the pair of flange portions 513 and 515.

A manufacturing method of the coil apparatus 501 having such a configuration will now be described. First, the pair of corresponding terminals 509 and 511 are connected and fixed to the pair of flange portions 513 and 515 in the ferrite core 503 by the adhesive 535. Subsequently, one winding end 537 of the winding 555 is soldered to the terminal 509, then the winding 555 is wound around the winding core portion 517 of the ferrite core 503, thereby forming the coil 505.

There is accepted a flyer winding method which is effected by rotating a nozzle with respect to the core which is fixed and remains stationary. Further, formation of the coil 505 is performed by the divided winding conformation, i.e., a conformation by which formation of the first coil portion 551 is completed and then the second coil portion 553 is formed.

After forming the coil 505, after one winding end 537 of the winding 555 is soldered to the terminal 511, cleansing and drying steps and others are carried out, then the insulating sheath body 507 covers the periphery of the ferrite core 503 or the coil 505 at the molding step.

Figure 29:
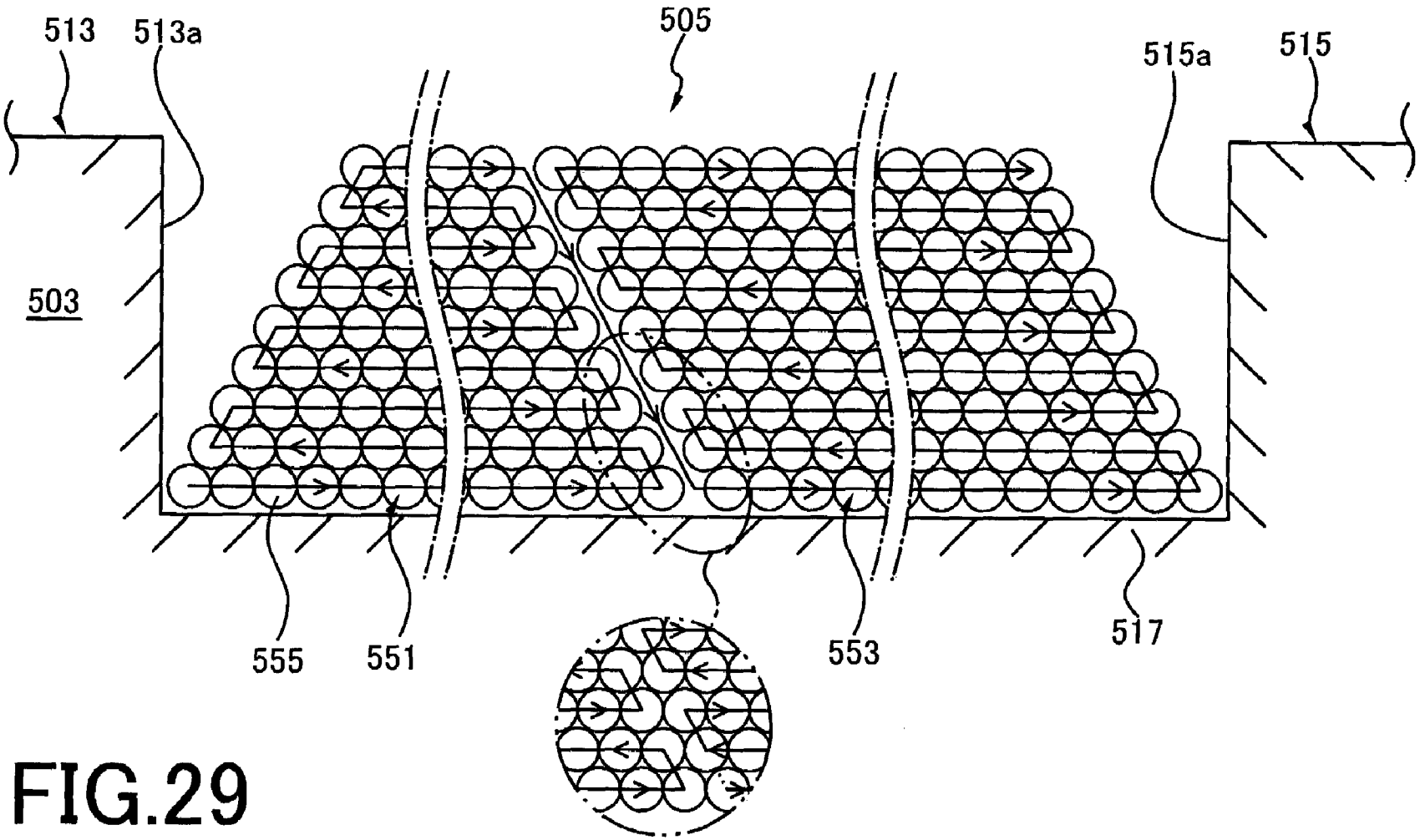
FIG. 29 is a view showing a winding conformation of a winding of the coil.

Furthermore, a procedure of forming the coil 505 on the ferrite core 503 will now be described in detail with reference to FIG. 29. First, in order to form the first coil portion 551 of the coil 505, the winding 555 is wound around the ferrite core 503 from a corner portion positioned between the surface 513*a* of the left flange portion 513 and the winding core portion 517 in FIG. 29.

As indicated by arrows in the drawing, a winding position of the winding 555 is first advanced toward the right flange portion 515 along the outer peripheral surface of the winding core portion 517, the winding 555 is wound for approximately 100 turns as a first layer, and then the winding 555 is turned back and wound toward the left flange portion 513 as a second layer. Thereafter, likewise, the winding position is advanced toward the right flange portion 515 to form a third layer, the winding 555 is turned back and advanced toward the left flange portion 513 to form a fourth layer, and a fifth layer, a sixth layer, a seventh layer, an eighth layer and a ninth layer are sequentially formed. It is to be noted that each of the first coil portion 551 and the second coil portion 553 is constituted of nine layers in this embodiment, the present invention is not restricted thereto, and the number of layers can be appropriately changed.

Reciprocating the winding position of the winding 555 in a predetermined range in this manner forms the first coil portion 551 in which the winding 555 is stacked in a radial direction of the ferrite core 503. Moreover, at this time, the number of turns per layer is reduced in an upper layer, i.e., a layer on an outer peripheral side in the radial direction. As a result, the boundary end surface $CF_1$ of the first coil portion 551 is formed while being inclined in the above-described direction.

Subsequently, after forming the first coil portion 551, the second coil portion 553 is formed. The boundary end surface $CF_2$ of the second coil portion 553 is formed in such a manner that it is mounted on the boundary end surface $CF_1$ of the first coil portion 551. After completion of formation of the first coil portion 551, a winding position of the winding 555 is advanced from the uppermost layer of the first coil portion 551 toward the outer peripheral surface of the winding core portion 517. Then, as a first layer in the second coil portion 553, the winding position of the winding 555 is advanced toward the right flange portion 515 along the outer peripheral surface of the winding core portion 517, the winding 555 is wound for approximately 100 turns, then it is turned back and wound toward the left flange portion 513 to form a second layer. Thereafter, likewise, the winding position is advanced toward the right flange portion 515 to form a third layer, then it is turned back and advanced toward the left flange portion 513 to form a fourth layer, and a fifth layer, a sixth layer, a seventh layer, an eighth layer and a ninth layer are sequentially formed. In this manner, the winding position of the winding 555 is likewise reciprocated in a predetermined range, and the winding 555 is stacked in the radial direction of the ferrite core 503 to form the second coil portion 553.

Here, in the divided winding conformation in which no flange is provided to the winding core portion 517, when forming the coil portion which is precedently provided, the winding is wound in a state where a space side of the coil portion which is subsequently formed is opened. Therefore, there is a possibility that the winding of the precedently formed coil portion may collapse while winding the wire of the coil portion which is subsequently formed.

Additionally, for example, when a wire having a cement coat is used, heating is temporarily performed at a stage where winding of the wire of the precedently formed coil portion is completed so that the end surface (including the other coil portion side on the flange portion side) of the coil portion is hardened by hardening of a cement component, whereby an effect of avoiding collapse of the winding can be expected. However, when a wire which has the cement coat is used, the cement component of the winding must be removed by a solvent or the like after completion of formation of the entire coil and before forming the insulating sheath body at the molding step. That is, there may possibly occur another problem that the manufacturing process becomes complicated.

On the contrary, in this embodiment, since the boundary end surface $CF_1$ of the first coil portion 551 which is precedently formed is inclined, collapse of the winding can be avoided even if a wire having no cement coat such as a urethane wire is used. That is, since the boundary end surface $CF_1$ of the first coil portion 551 accepts a stacked structure in which the winding is terminated at a part closer to the center of the winding portion in an upper layer (a layer on the outer peripheral side), the winding is stable and hardly collapses even though there is no support like a flange in a space on the second coil portion 553 side. It is to be noted that FIGS. 28 and 29 show that the first coil portion 551 and the second coil portion 553 are separated in order to clarify the drawings, but the boundary part of the two coil portions is actually formed without a gap like the inside of one coil portion as shown in a partial view indicated by a chain double-dashed line in FIG. 29.

As described above, according to the coil apparatus 501 of this embodiment, when forming the coil in the divided winding conformation, it is possible to prevent the winding of the precedently formed coil portion from collapsing while forming the next coil portion without providing a support such as a flange to the ferrite core 503. Therefore, the flange can be eliminated even in the divided winding conformation, and hence the ferrite core 503 can be reduced in size. It is to be noted that, when the ferrite core 503 is constituted to have the same entire length as that of an existing divided winding ferrite core having flanges, the winding can be wound more for an amount corresponding to elimination of the flanges.

Further, since the space between the pair of flange portions 513 and 515 can be formed as the uniform winding core portion 517 by eliminating flanges, the configuration of the ferrite core 503 can be simplified, thereby reducing a core manufacturing cost.

Furthermore, the coil 505 having the divided winding conformation can have a peak of an inductance at a higher frequency. Therefore, a region with a small rate of change in an inductance with respect to a frequency can be provided in a broader frequency range, thus facilitating stabilization of the inductance in a working frequency range desired by a customer.

Moreover, as described above, even though the boundary end surface $CF_1$ of the first coil portion 551 which is precedently formed is inclined, the boundary end surface $CF_2$ of the second coil portion 553 is likewise inclined, and hence the region between the pair of flange portions 513 and 515 can be effectively used as a wire winding region.

Additionally, the extra spaces 557 and 559 are respectively assured between the end surface $TF_1$ of the first coil portion 551 and the surface 513*a* of the flange portion 513 and between the end surface $TF_2$ of the second coil portion 553 and the surface 515*a* of the flange portion 515. Therefore, even if the winding of the coil 505 is expanded due to heat generated at the molding step of providing the insulating sheath body 507, the extra spaces 557 and 559 function as escape portions for the winding, and it is possible to prevent an unnecessary stress from acting on the pair of flange portions 513 and 515 of the ferrite core 503.

Further, in order to provide such extra spaces 557 and 559, the end surfaces $TF_1$ and $TF_2$ of the coil portions 551 and 553 do not accept a configuration in which they are supported by the surfaces 513*a* and 515*a*. However, the end surfaces $TF_1$ and $TF_2$ of the coil portions 551 and 553 are respectively inclined in the above-described direction, whereby the winding can be prevented from collapsing on the end surfaces $TF_1$ and $TF_2$.

Although the above has concretely described the contents of the present invention with reference to the preferred embodiment, it is self-evident that persons skilled in the art can accept various modifications based on basic technical concepts and teachings of the present invention.

Figure 30:
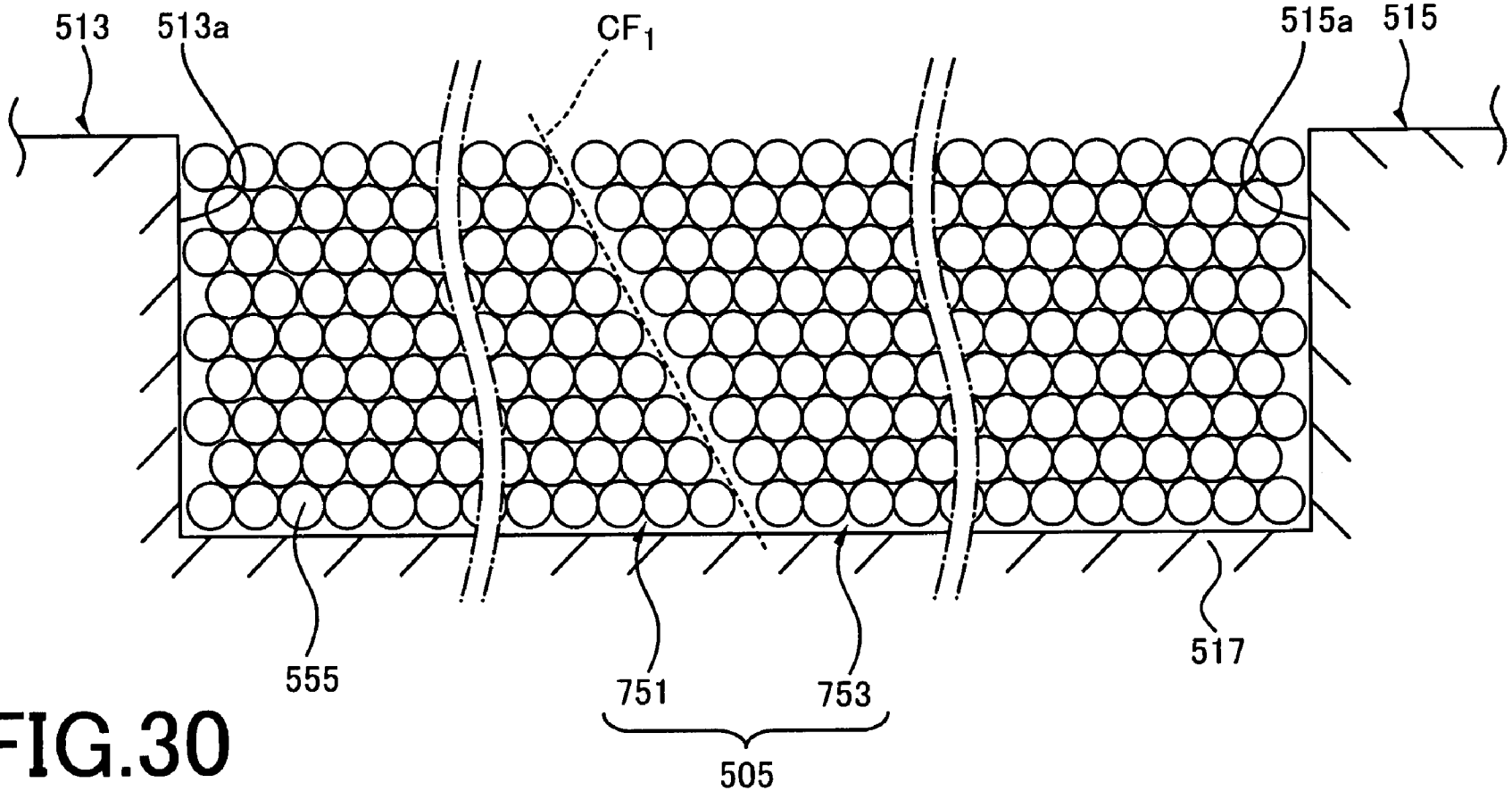
FIG. 30 is a view showing a configuration of a coil according to another embodiment of the present invention.

For example, although the end surfaces $TF_1$ and $TF_2$ of the coil portions 551 and 553 close to the corresponding flange portions 513 and 515 are inclined in the foregoing embodiment, the present invention is not restricted thereto. Therefore, as shown in FIG. 30, in coil portions 751 and 753 constituting the coil 505, end surfaces close to the corresponding flange portions 513 and 515 may be formed along the surfaces 513*a* and 515*a* of the flange portions 513 and 515. According to such a conformation, a region between the pair of flange portions 513 and 515 can be effectively used as a wire winding region.

Furthermore, although a urethane wire is used as the winding 555 in the foregoing embodiment, the present invention is not restricted thereto, and it is possible to appropriately use a wire such as a polyimide wire having excellent heat resistant properties.

Moreover, the end surface (including the other coil portion side on the flange portion side) of the coil portion in the coil 505 is not restricted to the conformation in which the end surface is inclined by accurately shifting each winding in accordance with each layer. That is, it is good enough if a fixed inclination relationship is assured between the outer peripheral side and the inner peripheral side of the coil portion, and hence the end surface of the coil portion may be inclined in, e.g., a stepped form or inclined with a position of the winding being shifted in an irregular pattern.

Additionally, the coil portion 505 in the coil apparatus 501 according to the present invention is not restricted to the configuration comprising two coil portions, and the coil 505 may include three or more coil portions. In such a case, when the boundary end surface formed on the precedently formed coil portion side is inclined in the precedently formed coil portion and the coil portions are sequentially provided, the same effects as those of the foregoing embodiment can be obtained.

Further, the coil apparatus 501 according to the present invention can be used as a keyless entry system, an immobilizer and an air pressure monitoring system mentioned above as well as an in-vehicle antenna and general electronic components which are not restricted to a vehicle-mounted purpose, e.g., antenna, transponder and inductor.

Each structure described or suggested in <Fifth Embodiment of the Invention> can be combined with an arbitrary structure described or suggested in <First Embodiment of the Invention>. For example, for each through hole 543 or 544 provided in each terminal 509 or 511, it is possible to adopt an arbitrary structure, arrangement, shape or the like described or suggested in <First Embodiment of the Invention>. A concrete example is as follows.

Each second portion (the intermediate portion) 527 or 529 in each terminal 509 or 511 has a hole 543 or 544 in a plane thereof, and both inner edges of each hole 543 or 544 opposed each other in at least one direction have an arc shape. Each hole 543 or 544 is not restricted to a circular hole, and it may be an oval hole, an elliptic hole or the like.

Moreover, it is possible to arbitrarily combine respective structures described or suggested in <First Embodiment of the Invention>, <Second Embodiment of the Invention>, <Third Embodiment of the Invention>, <Fourth Embodiment of the Invention> and <Fifth Embodiment of the Invention>.

Although the contents of the present invention has been concretely described with reference to the preferred embodiments, it is self-evident that persons skilled in the art can accept various modifications based on basic technical concepts and teachings of the present invention.

The invention claimed is:

1. A coil apparatus comprising:

a core;

a winding; and a terminal, wherein the core has terminal attachment portions at opposed both ends thereof, and has a winding portion in an intermediate portion thereof, the winding is wound around the winding portion, the terminal is a part to which an end of the winding is connected, formed of one metal sheet, and includes an attachment portion, an intermediate portion and a bottom portion, one end of the attachment portion is fixed to the terminal attachment portion of the core, one end of the intermediate portion is continuous with the other end of the attachment portion at a bent portion, the bottom portion has one end which is continuous with the other end of the intermediate portion at a bent portion, faces the attachment portion, and has the other end as a free end, and the intermediate portion has a hole in a plane thereof, both inner edges of the hole opposed to each other in at least one direction having an arc shape.

2. The coil apparatus according to claim 1, wherein the hole is arranged to be biased in a direction of the attachment portion.

3. The coil apparatus according to claim 1, wherein the terminal has an extended width portion in which a width is extended from the intermediate portion toward the bottom portion between the intermediate portion and the bottom portion.

4. The coil apparatus according to claim 1, wherein the hole has a circular shape.

5. The coil apparatus according to claim 1, wherein the hole has a short diameter and a long diameter, and a direction of the short diameter matches with a direction from the attachment portion to the bottom portion.

6. The coil apparatus according to claim 1, wherein the hole has a short diameter and a long diameter, and a direction of the long diameter matches with a direction from the attachment portion to the bottom portion.

7. The coil apparatus according to claim 5, wherein arc-shaped parts at both ends of the hole are continuous with each other through linear parts.

8. The coil apparatus according to claim 6, wherein arc-shaped parts at both ends of the hole are continuous with each other through linear parts.

9. The coil apparatus according to claim 5, wherein the hole has an elliptic shape.

10. The coil apparatus according to claim 6, wherein the hole has an elliptic shape.

11. The coil apparatus according to claim 1, further comprising an insulating sheath body, wherein the insulating sheath body covers the core and a coil provided around the core, the core includes a winding core portion constituted of the winding portion and a pair of flange portions formed at both ends of the winding core portion, and a cross section of the winding core portion orthogonal to a winding axis direction has a shape which includes bulge portions on a pair of opposed surfaces in a square shape.

12. The coil apparatus according to claim 11, wherein the bulge portion of the winding core portion is formed of a curved line in the cross section orthogonal to the coil winding axis direction.

13. The coil apparatus according to claim 11, wherein at least one winding escape portion is formed in the winding core portion, the winding escape portion is formed by being inwardly depressed apart from an arc line which is in contact with the bulge portion and connects the square angular portions on both sides of the bulge portion as seen in a lateral cross section of the winding core portion.

14. The coil apparatus according to claim 12, wherein at least one winding escape portion is formed in the winding core portion, the winding escape portion is formed by being inwardly depressed apart from an arc line which is in contact with the bulge portion and connects the square angular portions on both sides of the bulge portion as seen in a lateral cross section of the winding core portion.

15. The coil apparatus according to claim 11, wherein the winding core portion has flat portions on both sides of each of the bulge portions, and the flat portions are formed between the other pair of opposed surfaces in the square shape and the bulge portions.

16. The coil apparatus according to claim 11, wherein a part between an outer peripheral surface of the winding core portion and a surface of the flange portion on the winding core portion side is subjected to R processing or taper machining.

17. The coil apparatus according to claim 11, wherein a part between a surface on the winding core portion side and an outer peripheral surface on a radial outer side in the flange portion is subjected to R processing.

18. The coil apparatus according to claim 1, further comprising an insulating covering body, wherein the core includes a coil winding portion, the coil winding portion extending in a longitudinal direction, the winding is wound around the coil winding portion to constitute a coil, the insulating covering body is formed of a thermoplastic insulating resin and covers the core and the coil, and the core and the coil are positioned at a substantially central part of the insulating covering body.

19. The coil apparatus according to claim 18, wherein the insulating covering body is formed of a liquid crystal polymer.

20. The coil apparatus according to claim 1, further comprising an insulating resin sheath body, wherein the core is a rod-like body extending in one direction and has the winding portion in an intermediate portion thereof, the winding is wound around the winding portion, the insulating resin sheath body covers at least a part of the winding, at least one of the bent portions of the terminal is provided outside the insulating resin sheath body, and at least a part of a surface of the insulating resin sheath body is roughened.

21. The coil apparatus according to claim 1, wherein the winding is wound around the winding portion to constitute a coil, the coil includes at least a first coil portion and a second coil portion, and a boundary end surface of the first coil portion on the second coil portion side is inclined in such a manner that its inner peripheral side is closer to the second coil portion than its outer peripheral side.

22. The coil apparatus according to claim 21, wherein a boundary end surface of the second coil portion on the first coil portion side is inclined in such a manner that its outer peripheral side is closer to the first coil portion than its inner peripheral side.

23. The coil apparatus according to claim 1, wherein the coil apparatus is an antenna, a choke coil, or an inductor.

* * * * *